US008020545B2

(12) United States Patent
Smith

(10) Patent No.: US 8,020,545 B2
(45) Date of Patent: Sep. 20, 2011

(54) METHOD AND APPARATUS FOR SCRIBING TILE

(76) Inventor: Clyde Lewell Smith, St. Louis, MO (US)

( * ) Notice: Subject to any disclaimer, the term of this patent is extended or adjusted under 35 U.S.C. 154(b) by 0 days.

(21) Appl. No.: 12/798,819

(22) Filed: Apr. 12, 2010

(65) Prior Publication Data

US 2010/0192393 A1 Aug. 5, 2010

Related U.S. Application Data

(63) Continuation of application No. 11/148,747, filed on Jun. 8, 2005, now Pat. No. 7,694,670.

(51) Int. Cl.
*B28D 1/32* (2006.01)

(52) U.S. Cl. ..... 125/23.01

(58) Field of Classification Search ..... 125/23.01; 33/426, 456, 468, 469, 472, 495, 499, 500, 33/526, 527, 534; 403/62, 83–85, 91–97, 403/101, 289, 326, 348, 349

See application file for complete search history.

(56) References Cited

U.S. PATENT DOCUMENTS

| | | | | |
|---|---|---|---|---|
| 2,331,382 | A * | 10/1943 | Eubanks | 33/439 |
| 2,770,043 | A | 11/1956 | Kwiecinski | |
| 3,718,980 | A | 3/1973 | Poulos | |
| 4,827,625 | A | 5/1989 | Le Moal | |
| 5,038,490 | A * | 8/1991 | Armstrong | 33/527 |
| 5,205,045 | A | 4/1993 | Liu | |
| 5,361,508 | A | 11/1994 | Ruggiero | |
| 5,471,758 | A | 12/1995 | White, Sr. | |
| 5,483,749 | A | 1/1996 | Hepworth | |
| 5,617,642 | A | 4/1997 | Marios | |
| 5,701,680 | A | 12/1997 | Garcia et al. | |
| 6,520,465 | B1 * | 2/2003 | Sack et al. | 248/227.4 |
| 2003/0033724 | A1 * | 2/2003 | Barbosa | 33/526 |
| 2005/0109187 | A1 | 5/2005 | Smith | |

FOREIGN PATENT DOCUMENTS

DE 4100039 A1 7/1992

* cited by examiner

*Primary Examiner* — David B Thomas

(57) ABSTRACT

A method and apparatus for scribing tile is disclosed. The disclosed scribing tool preferably comprises a scribe member, a tile engagement member, and an extension member. The scribe member is preferably connected to the tile engagement member via the extension member. The extension member is preferably pivotally connected to the scribe member and both pivotally and slideably connected to the tile engagement member.

25 Claims, 23 Drawing Sheets

METHOD AND APPARATUS FOR SCRIBING TILE

This application is a continuation of U.S. patent application Ser. No. 11/148,747, filed on Jun. 8, 2005, and titled METHOD AND APPARATUS FOR SCRIBING TILE, which is a continuation-in-part of U.S. patent application Ser. No. 10/721,041, filed on Nov. 24, 2003, and titled METHOD AND APPARATUS FOR SCRIBING TILE.

BACKGROUND OF THE INVENTION

In the art of laying tile, it is often necessary to trim or cut tiles to fit against various boundary perimeters. The act of scribing such tile is often the most laborious and time-consuming step of a tiling project. Furthermore, inaccuracies or mistakes made while scribing tile often results in wasted tile and increases the time it takes to complete tiling projects. As such, many techniques and devices have been developed in an effort reduce the time and complexity of the tile scribing process.

Some techniques of scribing tile involve the use of tools that are specifically adapted for such purpose. Examples of such tools include those described in the disclosures of U.S. Pat. Nos. 5,701,680, 5,617,642, 5,483,749, 5,471,758, 5,361,508, 4,827,625, 3,718,980, and 2,770,043, which disclosures are hereby incorporated into this disclosure by reference. While at least some of such devices allow a person to scribe tile accurately to a boundary perimeter, in general, they are also cumbersome and time consuming to utilize. In particular, such devices often include many adjustable components that must be set and locked relative to each other, often by using threaded fasteners, thereby making such devices difficult to utilize with only two hands. On the other hand, other devices, while being relatively simple and quick to utilize, lack versatility and are often only suited for specific scribing tasks.

As a result of the above-mentioned disadvantages associated with previously developed scribing tools, the act of scribing tile is most often performed using conventional tools, such as rulers, or by using other techniques well known in that art of tiling, such as inverting tiles. These techniques typically involve measuring and marking multiple reference points on a tile and then scribing the tile between such points. While such techniques can be used to scribe tile to either simple or complex boundary perimeters, these techniques also create numerous opportunities for mistakes to be made and, in some cases, can be very tedious and time consuming to utilize. Nonetheless, these manual measuring techniques are typically favored over the use of specifically adapted scribing tools, such as those discussed above, due to the described disadvantages associated with such scribing tools.

SUMMARY OF THE INVENTION

The scribing tool of the present invention was specifically developed to provide and alternative to prior art scribing tools and manual measuring techniques, and to overcome the disadvantages associated therewith. As a result, the scribing tool of the present invention allows tile to be scribed accurately and rapidly using just a few simple steps. Additionally, the scribing tool of the present invention is versatile and is low in cost to produce.

In a first aspect of the invention, an apparatus for scribing tile comprises a scribe member, a tile engagement member, an extension member, and a locking member. The extension member connects the scribe member to the tile engagement member and is movably connected to the tile engagement member. The locking member is movable between a locking position and an unlocking position and prevents movement of the tile engagement member relative to the extension member when in its locking position, while allowing movement of the tile engagement member relative to the extension member when in its unlocking position. Additionally, the locking member is biased from the unlocking position toward the locking position.

In a second aspect of the invention, a method comprises providing a surface onto which it is desired to lay tile up to a boundary perimeter. The method further comprises the step of providing first, second, and third tiles. The first and second tiles each have a straight edge and the third tile has first and second straight edges. The method yet further comprises, securing the first and second tiles to the surface in a manner such that the edge of the first tile is oriented generally perpendicular to the edge of the second tile and in a manner defining a portion of the surface that is at least partially bound by the edge of the first tile, the edge of the second tile, and the boundary perimeter.

Still further, the method includes the step of providing a scribing tool that comprises a scribe member, a tile engagement member, and an extension member. The extension member connects the scribe member to the tile engagement member and is pivotally connected to the tile engagement member. The tile engagement member comprises first, second, third, and fourth engagement portions.

This method also includes the steps of aligning the scribe member with a portion of the boundary perimeter and engaging the tile engagement member with the first and second tiles. The engagement of the tile engagement member with the first and second tiles occurs by pivoting the tile engagement member relative to the extension member in a manner such that the first engagement portion of the tile engagement member engages the edge of the first tile and such that the second engagement portion of the tile engagement member engages the edge of the second tile, while the scribe member is aligned with the portion of the boundary perimeter.

Still further, the method comprises locking the tile engagement member relative to the extension member in a manner such that the scribe member fixed in orientation relative to the tile engagement member with the tile engagement member engaged with the first and second tiles as recited and with the scribe member aligned with the portion of the boundary perimeter as recited. Additionally, the method comprises engaging the tile engagement member with the third tile in a manner such that the third engagement portion of the tile engagement member engages the first edge of the third tile and such that the fourth engagement portion of the tile engagement member engages the second edge of the third tile. This occurs while the tile engagement member is locked in the fixed orientation relative to the extension member and in a manner such that the first edge of the third tile is separated from the first engagement portion of the tile engagement member by a distance and the second edge of the third tile is separated from the second engagement portion of the tile engagement member by the same distance.

Finally, this method comprises scribing the third tile via the scribe member when the tile engagement member is engaged with the third tile as recited.

In a third aspect of the invention, a method comprises providing a scribing tool. The scribing tool comprises a scribe member, a tile engagement member, an extension member, and a locking member. The extension member connects the scribe member to the tile engagement member and is movably connected to the tile engagement member. The locking member is movable between a locking position and an unlocking position, wherein it prevents movement of the tile engagement member relative to the extension member when in the locking position and allows movement of the tile engagement member relative to the extension member when in the unlocking position. The locking member is also biased from the unlocking position toward the locking position.

The method further includes moving the extension member relative to the tile engagement member by applying a force causing the locking member to move out of the locking position and into the unlocking position. Still further, the method comprises releasing the applied force on the locking member in a manner such that the locking member moves out of the unlocking position and into the locking position as a result of the locking member being biased from the unlocking position toward the locking position.

In a fourth aspect of the invention, a scribing tool comprises a scribe member, an extension member, and a tile engagement member. The tile engagement member is connected to the scribe member via the extension member. The scribe member is pivotally connected to the extension member about a first axis. The tile engagement member comprises first and second portions. The first portion of the tile engagement member is slideably connected to the extension member. The second portion of the tile engagement member is pivotally connected to the extension member via the first portion of the tile engagement member about a second axis that is movable with the first portion relative to the extension member. The second portion of the tile engagement member is movable relative to the first portion of the tile engagement member along a path that extends through a first plane that is parallel to and includes the second axis. The path and the first plane are pivotally movable with each other and with the second portion of the tile engagement member about the second axis relative to the extension member and are slideably movable with the first portion of the tile engagement member relative to the extension member.

In a fifth aspect of the invention, a scribing tool comprises a scribe member, an extension member, and a tile engagement member. The tile engagement member is connected to the scribe member via the extension member. The tile engagement member is also slideably connected to the extension member. The scribing tool is adapted and configured such that the scribe member and the extension member have a locked condition and an unlocked condition relative to each other. The scribe member is pivotally movable relative to the extension member about a first axis when the scribe member and the extension member are in their unlocked condition and is rotationally fixed relative to the extension member when the scribe member and the extension member are in their locked condition. The scribing tool is further adapted and configured such that an applied force is required to place the scribe member and the extension member in their unlocked condition and such that the scribe member and the extension member are automatically placed in their locked condition when the applied force is released.

While the principal advantages and features of the invention have been described above, a more complete and thorough understanding of the invention may be obtained by referring to the drawings and the detailed description of the preferred embodiments, which follow.

Figure 1:
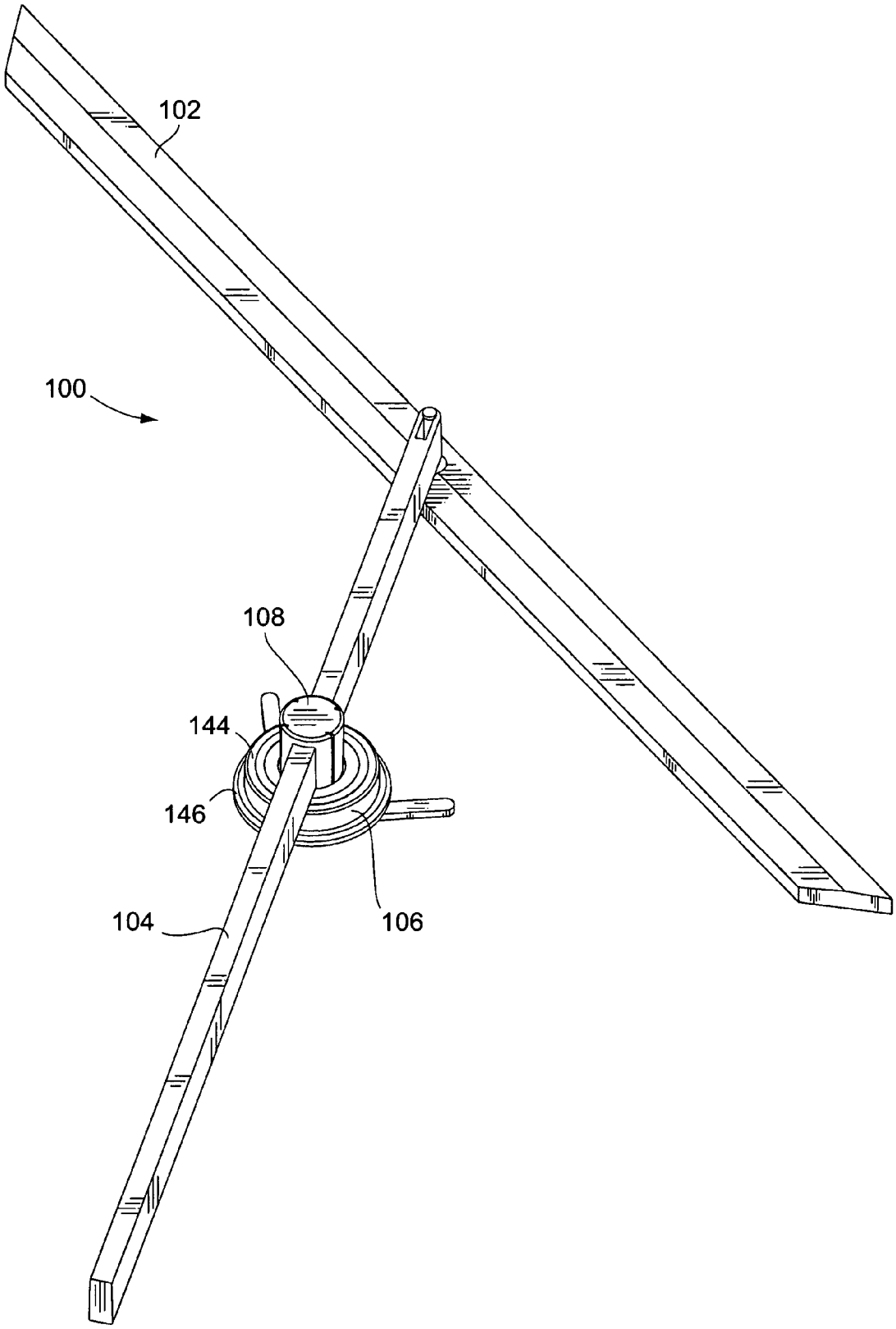
FIG. 1 is a perspective view of a first embodiment of a scribing tool in accordance with the invention.

Reference characters in the written specification indicate corresponding items shown throughout the drawing figures.

DETAILED DESCRIPTION OF THE PREFERRED EMBODIMENTS OF THE INVENTION

Figure 25:
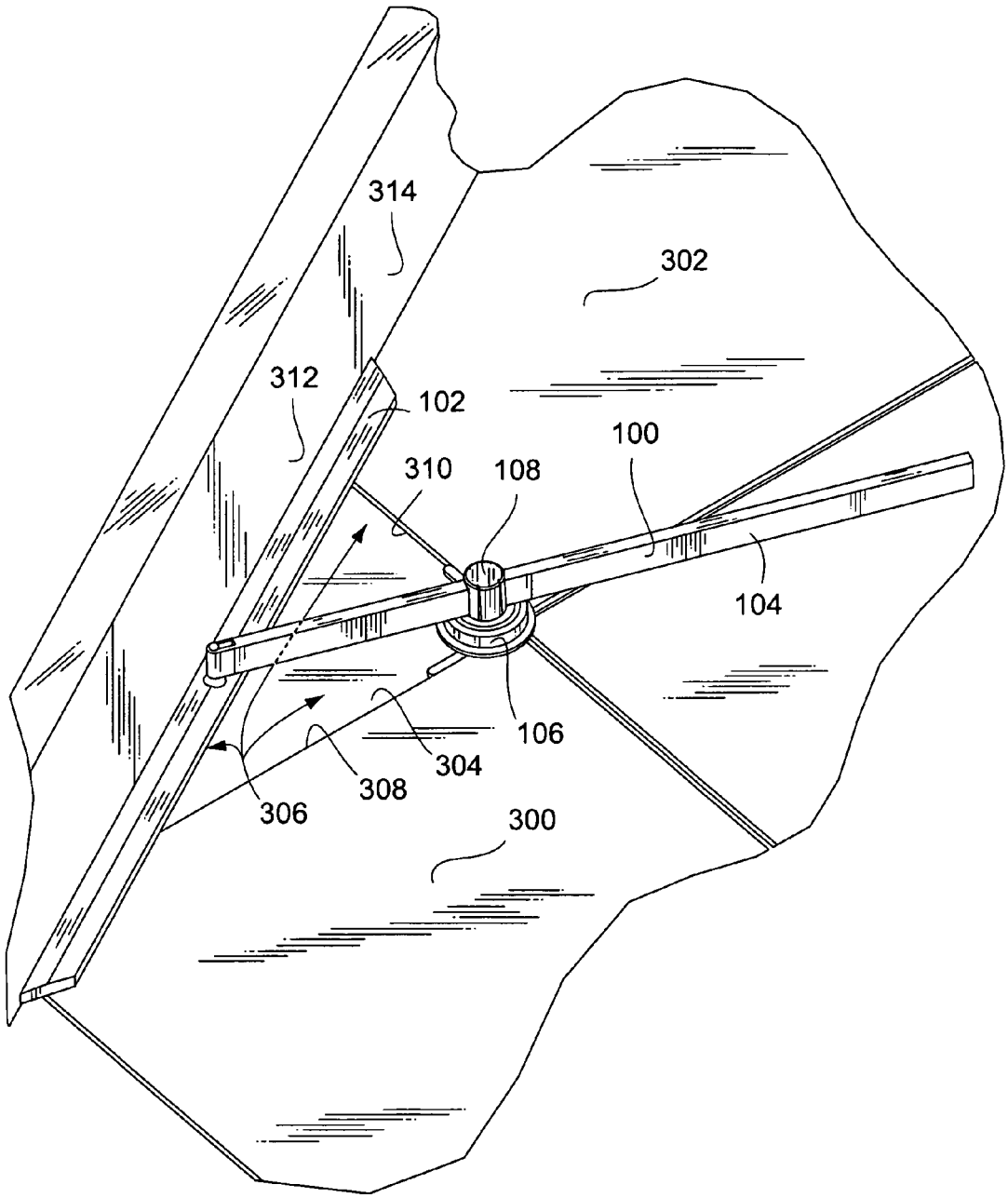
FIG. 25 is a perspective view of the scribing tool shown in FIG. 1 being utilized to measure to a portion of a boundary perimeter of a space onto which a tile is sought to be laid.
Figure 26:
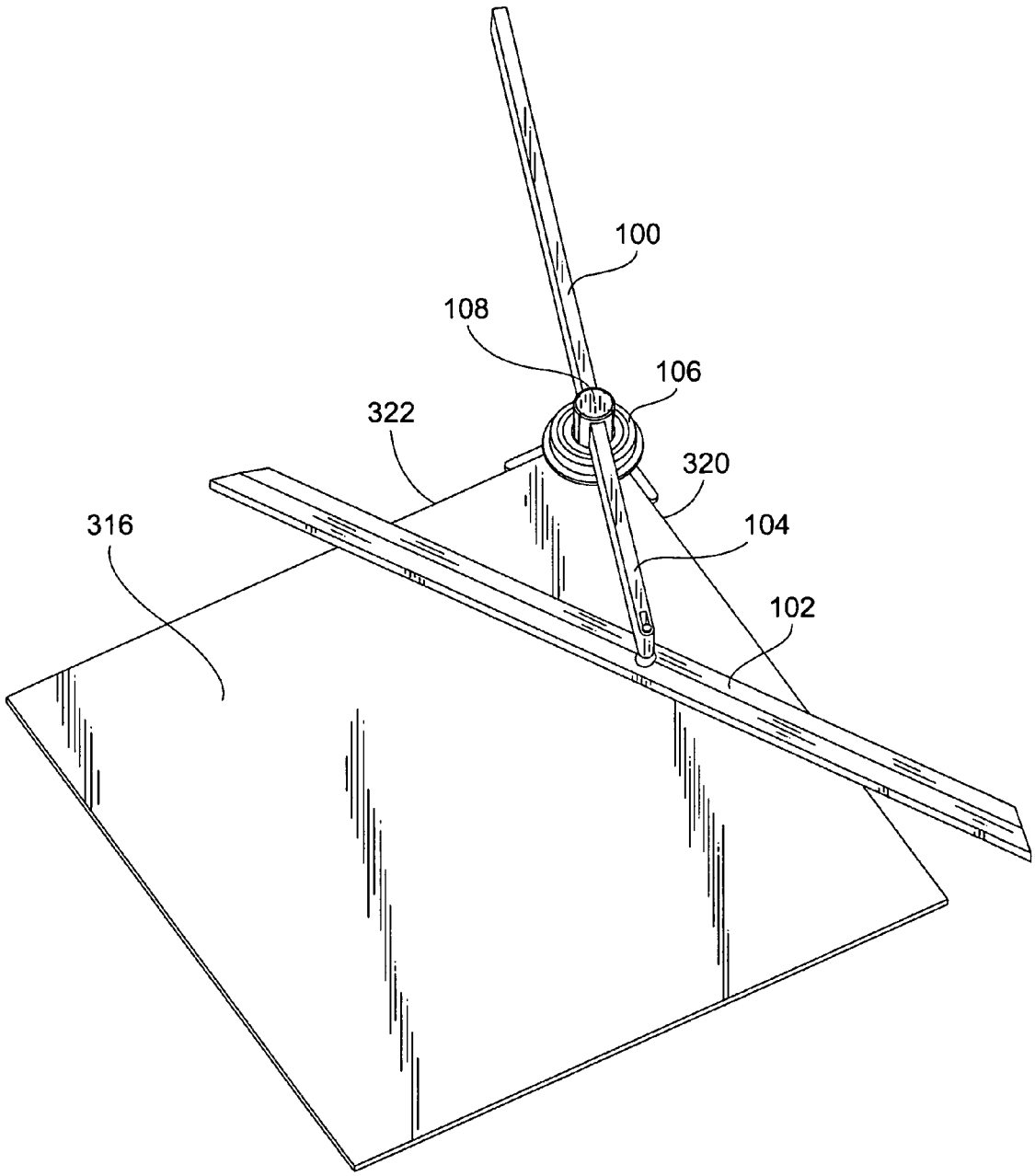
FIG. 26 is a perspective view of the scribing tool shown in FIG. 1 being utilized to indicate where to scribe a tile so that the tile will fit in the space shown in FIG. 25.

A first embodiment of a scribing tool in accordance with the invention is shown in its entirety in FIGS. 1, 25, and 26. In general, the scribing tool 100 preferably comprises a scribe member 102, an extension member 104, a tile engagement member 106, and a locking member 108.

Figure 2:
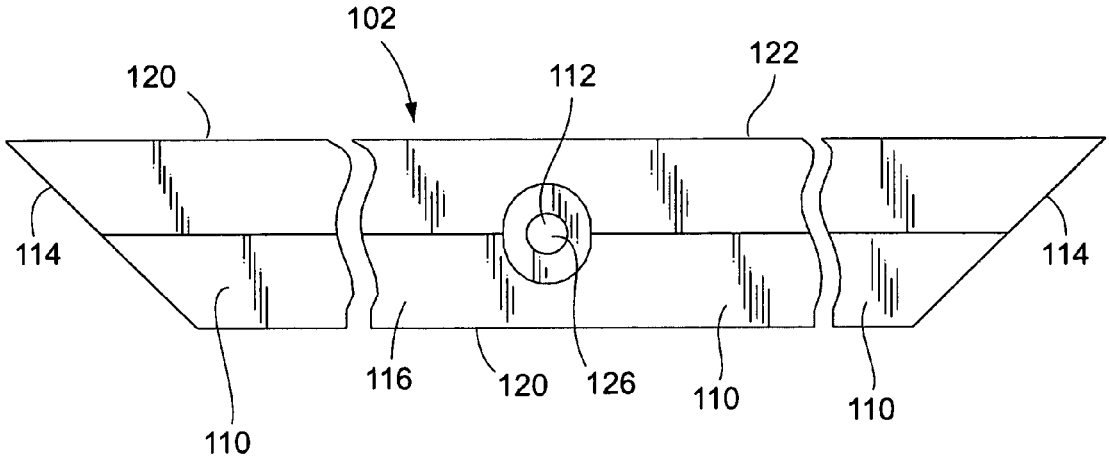
FIG. 2 is a broken top view of the scribe member of the scribing tool shown in FIG. 1.
Figure 3:
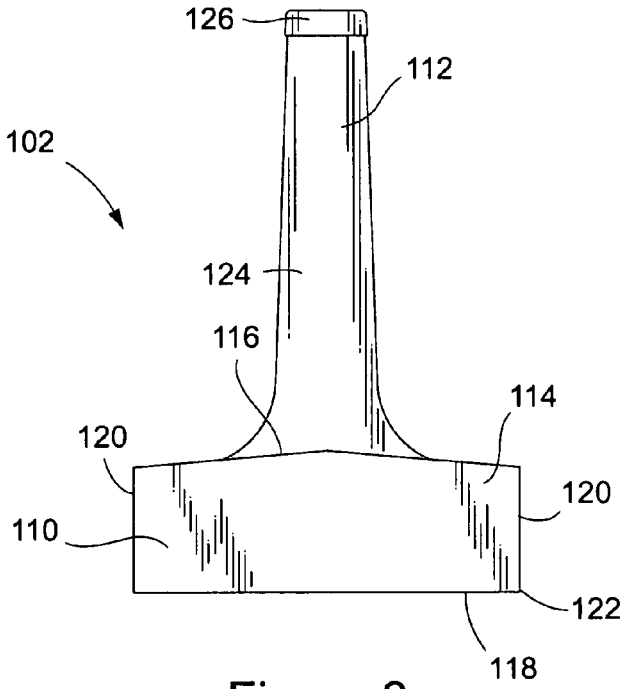
FIG. 3 is a side view of the scribe member shown in FIG. 2.
Figure 4:
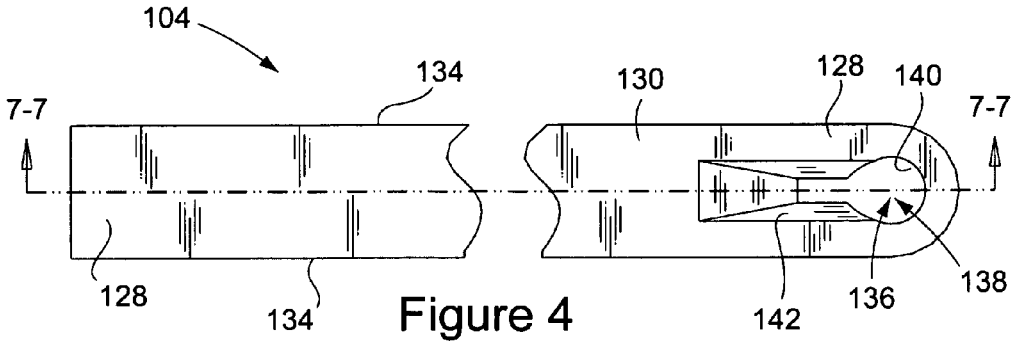
FIG. 4 is a broken top view of the extension member of the scribing tool shown in FIG. 1.
Figure 5:
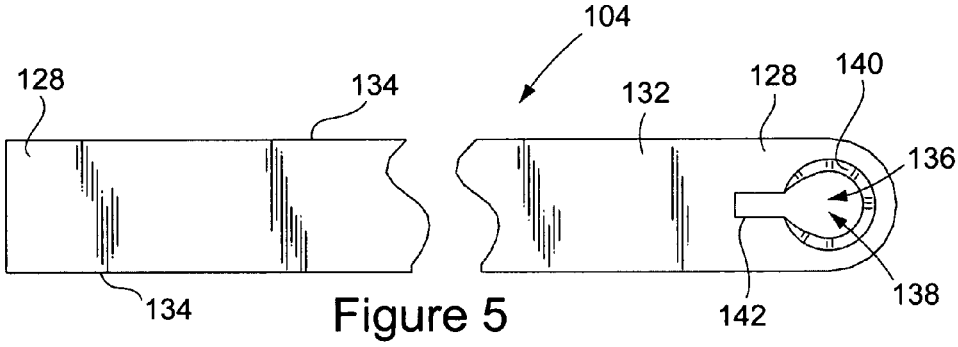
FIG. 5 is a broken bottom view of the extension member shown in FIG. 4.

The scribe member 102 of the scribing tool 100, shown by itself in FIGS. 2 and 3, preferably comprises a beam portion 110 and an attachment portion 112. Configured as shown, the scribe member 102 is preferably fabricated as a single monolithic molded component of plastic or metal. The beam portion 110 has a longitudinal length that extends between opposite longitudinal ends 114. The beam portion 110 also preferably comprises a top 116, a bottom 118, and opposite sides 120 that extend between its longitudinal ends 114. The bottom 118 of the beam portion 110 is preferably flat and preferably forms a straight edge 122 with at least one of the opposite sides 120. The top 116 of the beam portion 110 is preferably peaked in manner such that its surfaces are non-parallel to the bottom 118 of the beam portion. This facilitates the easy removal of the scribe member 102 from two-part a mold during its formation. The opposite longitudinal ends 114 of the beam portion 110 each preferably forms an acute angle of preferably forty-five degrees with the straight edge 122.

The attachment portion 112 of the scribe member 102 is preferably centrally located between the longitudinal ends 114 of the beam portion 110 and protrudes upward from the top 116 of the beam portion. The attachment portion 112 preferably comprises a frustoconical column 124 that gradually reduces in diameter as it extends upward from the top 116 of the beam portion 110. The top of the attachment portion 112 terminates with a nub 126 that is slightly larger in diameter than the portion of the column 124 immediately beneath the nub.

Figure 6:
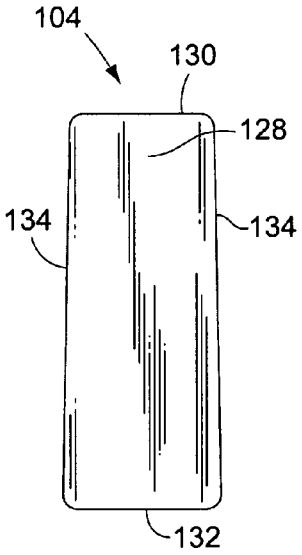
FIG. 6 is a side view of the extension member shown in FIG. 4.
Figure 7:
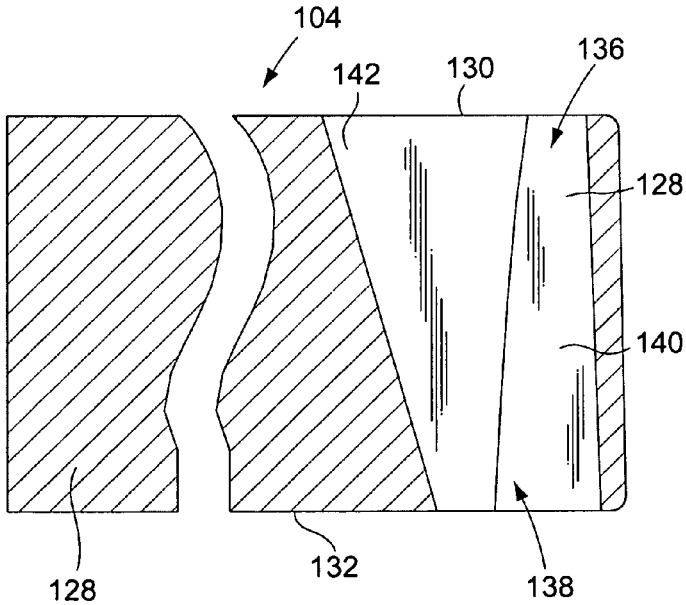
FIG. 7 is a broken cross-sectional view of the extension member shown in FIG. 4, taken about the line 7-7 shown in FIG. 4.

The extension member 104 of the scribe tool 100 is shown by itself in FIGS. 4-7. The extension member 104 is preferably an elongate member having a cross-section, as shown in FIG. 6, that generally extends between its opposite longitudinal ends 128 and, like the scribe member 102, is preferably fabricated as a single monolithic molded component of plastic or metal. Additionally, the extension member 104 preferably has a flat top 130, a flat bottom 132, and opposite sides 134. The sides 134 of the extension member 104 preferably taper toward each other as they extend upward between the bottom 132 and top 130 of the extension member to facilitate easy removal of the extension member 104 from a two-part mold during its formation. One of the longitudinal ends 128 of the extension member 104 is preferably provided with an attachment portion 136.

The attachment portion 136 of the extension member 104 preferably comprises an opening 138 that extends vertically from the top 130 to the bottom 132 of the extension member. The opening 138 preferably has a partial frustoconical surface 140 that joins with an adjacent slot portion 142. The partial frustoconical surface 140 tapers toward itself as it extends upward from the bottom 132 to the top 130 of the extension member 104. The slot portion 142 has a length that extends along the longitudinal direction of the extension member 104 and a width that extends perpendicular to the sides 134 of the extension member. The length of the slot portion 142 is preferably greater than the slot portion's width. Additionally, the slot portion 142 preferably slopes lengthwise away from the partial frustoconical surface 140, while also expanding widthwise, as the slot portion extends upward from the bottom 132 to the top 130 of the extension member 104. This configuration of the attachment portion 136, like the overall configuration of the extension member 104 facilitates, the easy removal of the extension member from a two-part mold during its formation.

Figure 8:
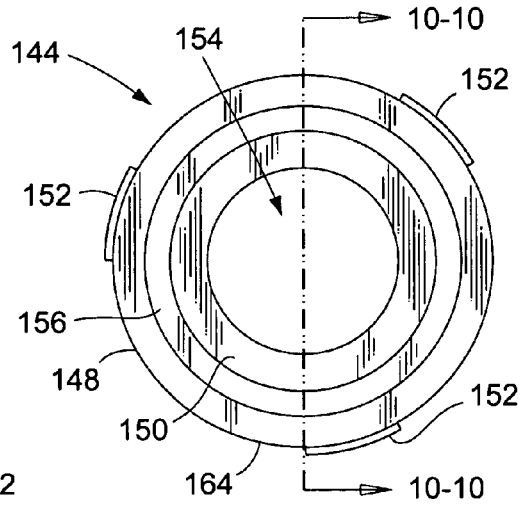
FIG. 8 is a top view of the upper portion of the tile engagement member of the scribing tool shown in FIG. 1.
Figure 9:
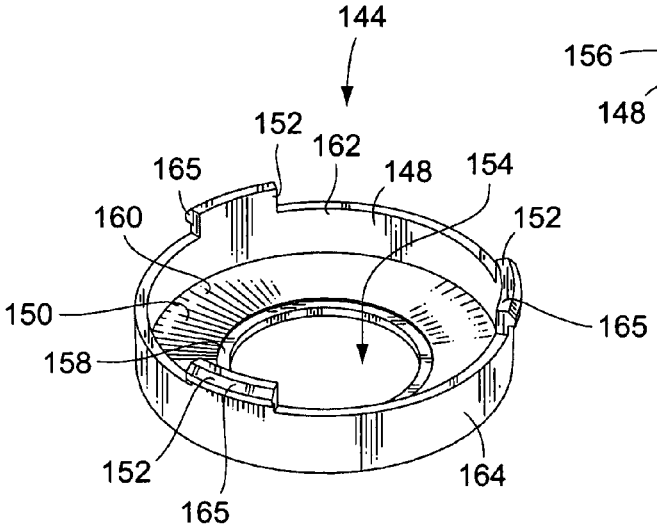
FIG. 9 is a perspective view of the upper portion of the tile engagement member shown in FIG. 8, as seen from beneath the upper portion.
Figure 10:
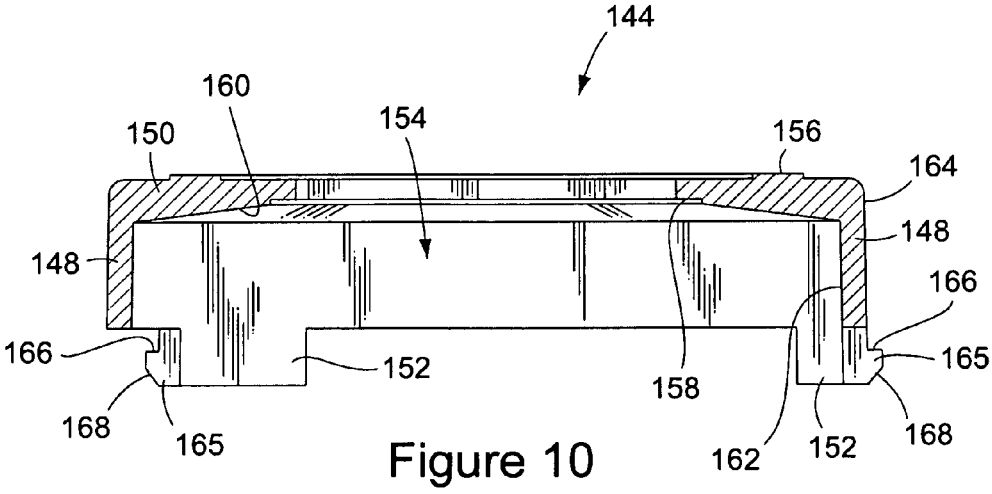
FIG. 10 is a cross-sectional view of the upper portion of the tile engagement member shown in FIG. 8, taken about the line 10-10 shown in FIG. 8.

The tile engagement member 106 preferably comprises separate upper 144 and lower 146 portions, both of which are preferably formed of plastic material via two-part molds. The upper portion 144 is shown by itself in FIGS. 8-10 and preferably comprises a generally frustoconical wall portion 148, a top wall portion 150, and a plurality of locking tabs 152. The frustoconical wall portion 148 preferably tapers toward its center axis slightly as it extends upward from the locking tabs 152 to the top wall portion 150, so as to accommodate the draft angles necessary for molded production. The top wall portion 150 preferably extends radially inward from the top of the frustoconical wall portion 148 and has a generally cylindrical central opening 154. A raised annular rim 156 preferably protrudes upward from the top wall portion 150. The bottom side of the top wall portion 150 preferably comprises a recessed annular rim 158 and a frustoconically sloped cam surface 160. The recessed annular rim 158 is positioned immediately adjacent the central opening 154 of the top wall portion 150 and is preferably planar. The sloped cam surface 160 of the top wall portion 150 preferably tapers radially inward as it extends upward from the frustoconical wall portion 148 to the recessed annular rim 158.

The upper portion 144 of the tile engagement member 106 preferably has three locking tabs 152 that extend downward from the frustoconical wall portion 148, matching the contour of the inner surface 162 of the frustoconical wall portion as they so extend. The locking tabs 152 are preferably equally spaced, and a portion of each locking tab also matches the contour of the outer surface 164 of the frustoconical wall portion 148 as the locking tabs extend downward therefrom. However, each locking tab 152 also has a barb 165 that extends radially outward from the outer surface 164 of the frustoconical wall portion 148, thereby creating opposite locking 166 and cam 168 surfaces. The locking surfaces 166 of the locking tabs 152 are preferably coplanar while the cam surfaces 168 slope radially outward as they extend upward.

Figure 11:
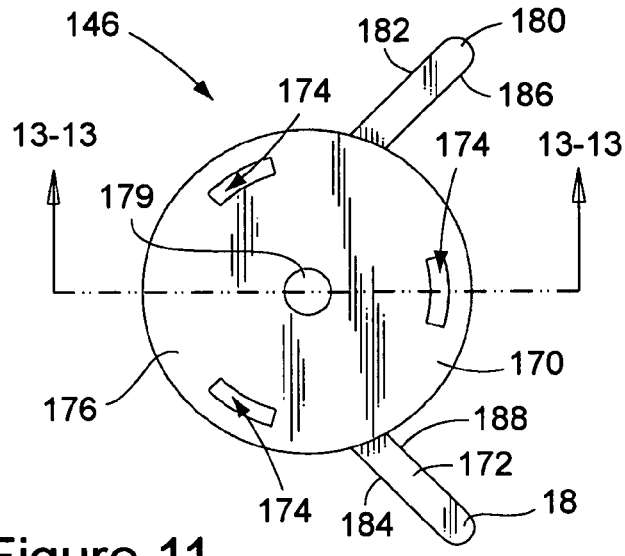
FIG. 11 is a top view of the lower portion of the tile engagement member of the scribing tool shown in FIG. 1.
Figure 12:
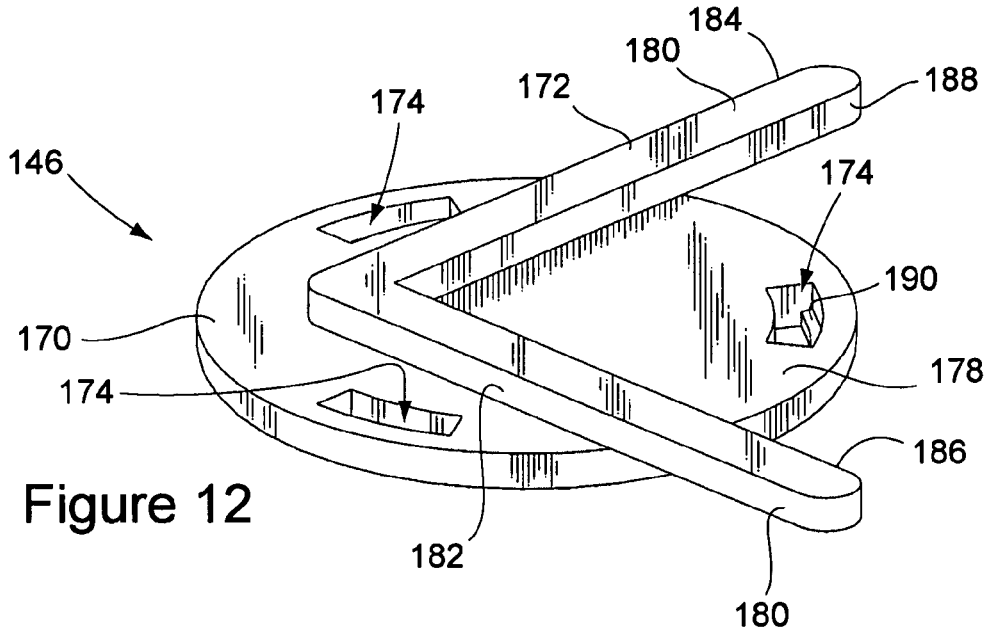
FIG. 12 is a perspective view of the lower portion of the tile engagement member shown in FIG. 11, as seen from beneath the lower portion.
Figure 13:
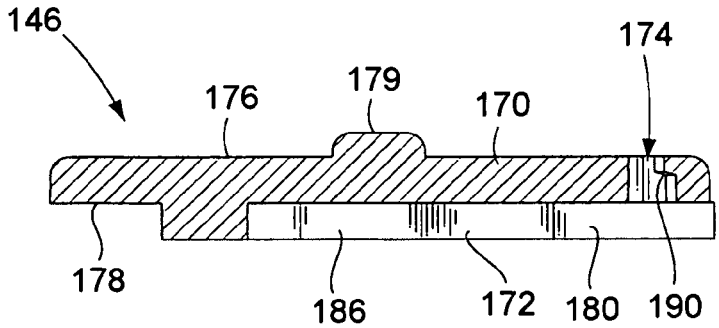
FIG. 13 is a cross-sectional view of the lower portion of the tile engagement member shown in FIG. 11, taken about the line 13-13 shown in FIG. 11.
Figure 14:
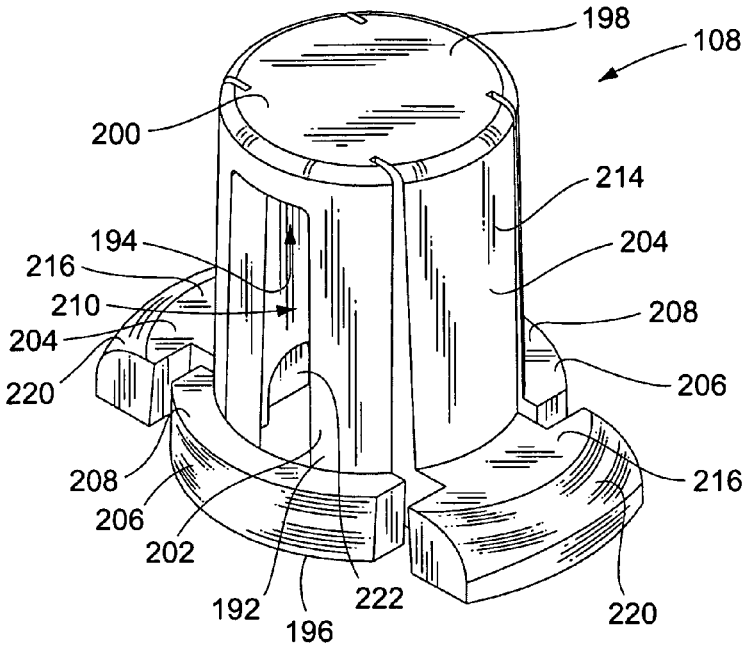
FIG. 14 is a perspective view of the locking member of the scribing tool shown in FIG. 1, as seen from above the locking member.
Figure 15:
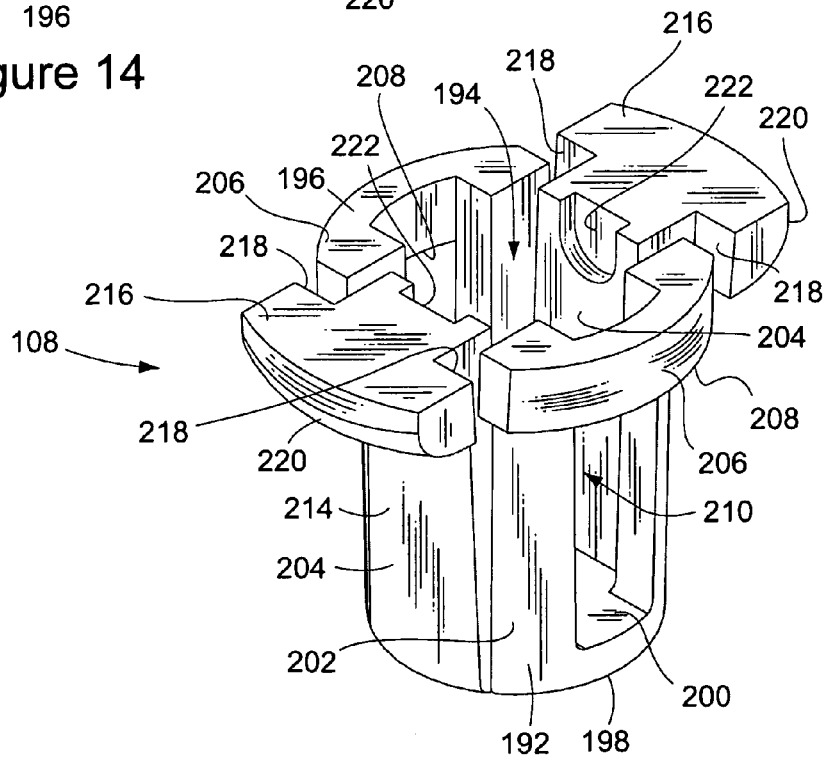
FIG. 15 is a perspective view of the locking member shown in FIG. 14, as seen from beneath the locking member.
Figure 16:
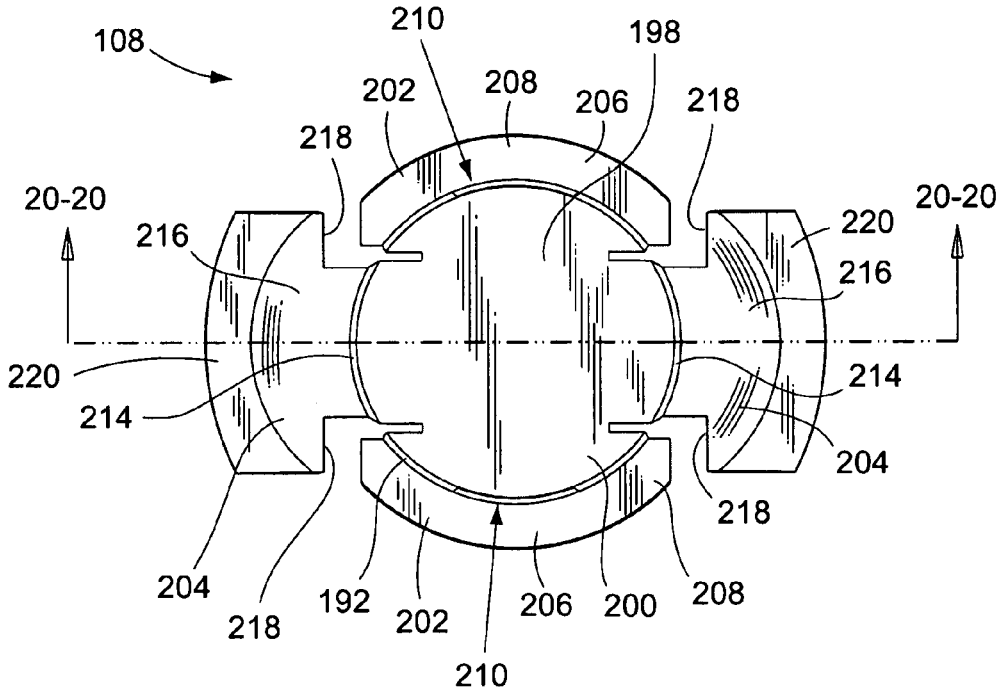
FIG. 16 is a top view of the locking member shown in FIG. 14.
Figure 17:
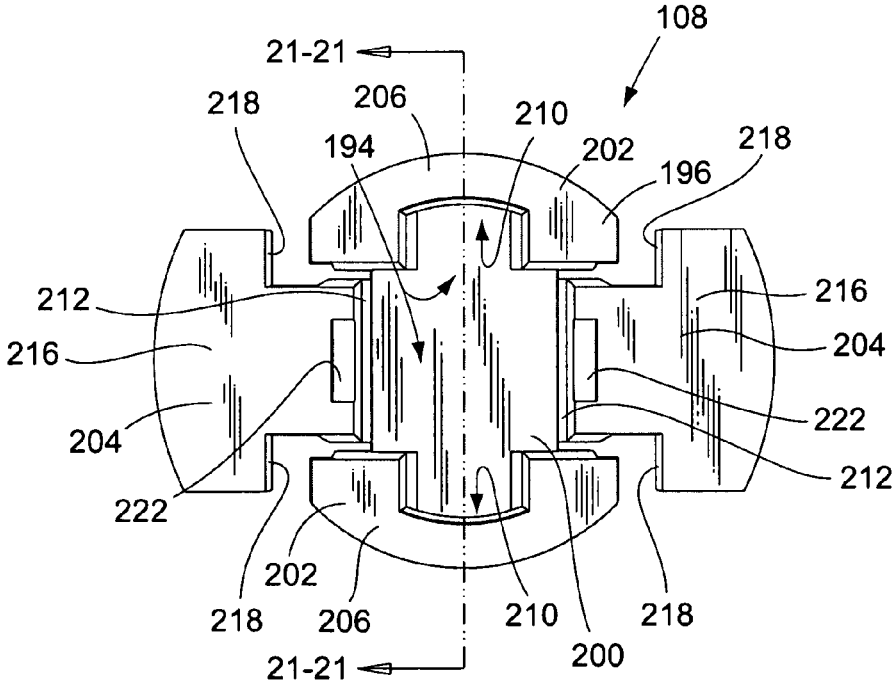
FIG. 17 is a bottom view of the locking member shown in FIG. 14.
Figure 18:
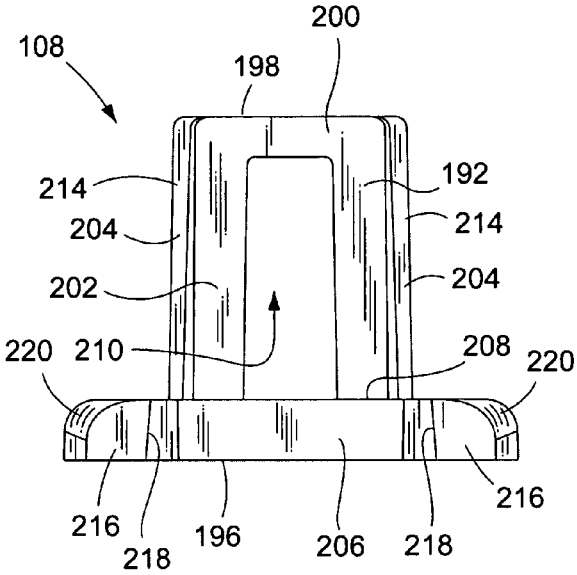
FIG. 18 is a front view of the locking member shown in FIG. 14.
Figure 19:
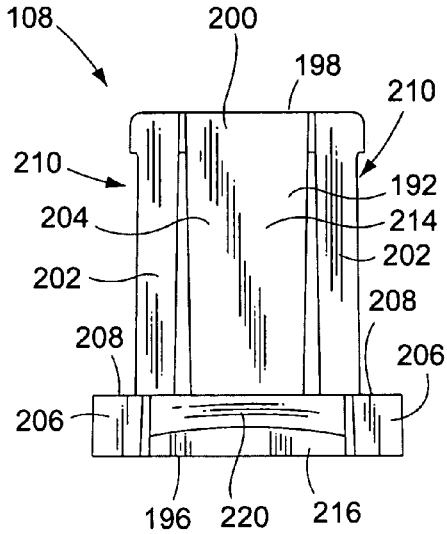
FIG. 19 is a side view of the locking member shown in FIG. 14.
Figure 20:
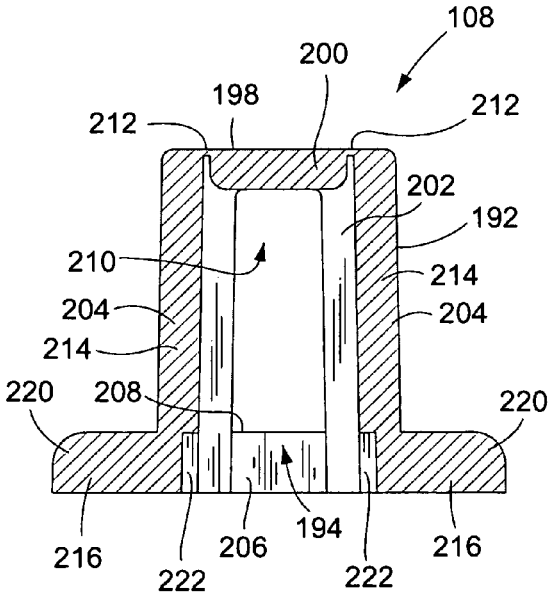
FIG. 20 is a cross-sectional view of the locking member, taken about the line 20-20 shown in FIG. 16.
Figure 21:
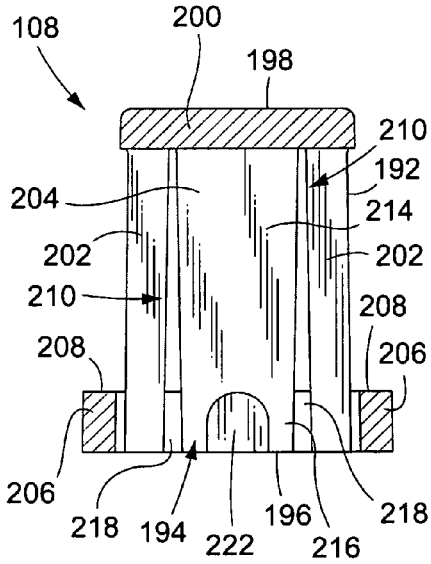
FIG. 21 is a cross-sectional view of the locking member, taken about the line 21-21 shown in FIG. 17.
Figure 22:
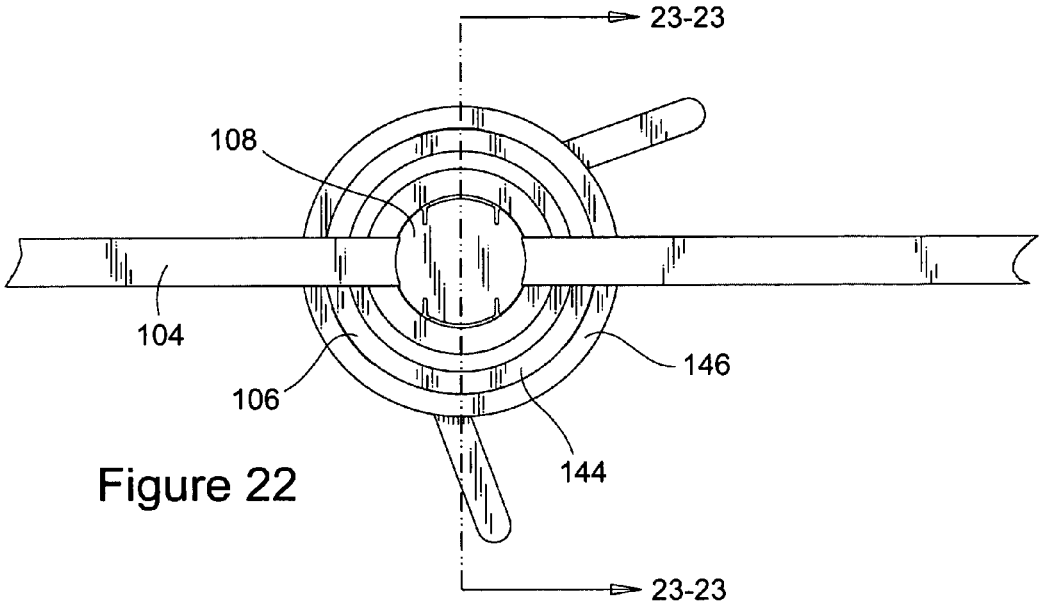
FIG. 22 is a top view of the tile engagement member, the locking member, and a portion of the extension member of the scribing tool shown in FIG. 1, with such components assembled together.

The lower portion 146 of the tile engagement member 106 is shown by itself in FIGS. 11-13 and preferably comprises a generally discoidal main body 170 and an L-shaped protrusion 172 that extends downward therefrom. Like many of the other components of the scribing tool 100, the lower portion 146 of the tile engagement member 106 is preferably formed of plastic or metal material and is preferably configured to be molded via a two-part mold. A plurality of openings 174 extend through the main body 170 from the main body's opposite top 176 and bottom 178 surfaces. The top surface 176 of the main body 170 is preferably generally flat with the exception of a centrally positioned cylindrical nub portion 179 that extends upward. The L-shaped protrusion 172 preferably forms two legs 180 that are oriented at a right-angle relative to each other. Each of the legs 180 preferably extends beyond the outer diameter of the main body 170. The legs 180 of the L-shaped protrusion 172 preferably form first 182, second 184, third 186, and fourth 188 engagement portions that extend vertically downward from the bottom surface 178 of the main body 170. The openings 174 of the main body 170 of the lower portion 146 are preferably equally spaced and each preferably extends along an arc that shares a common axis with the circumference of the main body. Portions of the main body 170 preferably extend radially inward into each opening 174 adjacent the top surface 176 of the main body, thereby forming locking surfaces 190.

Like the above-mentioned components of the scribing tool 100, the locking member 108, shown by itself in FIGS. 14-21, is preferably formed of plastic or metal and is preferably configured to be molded as a single monolithic piece via a two-part mold. The locking member 108 preferably comprises a main, generally frustoconical, outer surface 192 that extends circumferentially about a vertical axis and that tapers toward itself as it extends upward. The main outer surface 192 is preferably frustoconical in shape to accommodate a draft-angle for purposes of facilitating the molding of the locking member 108. A primary opening 194 preferably extends upward through the center of the locking member 108 from the bottom surface 196 of the locking member and terminates short of the top surface 198 of the locking member. Extending downward from its upper portion 200, the locking member 108 preferably comprises opposite side wall portions 202 and a pair of opposite leg portions 204, with the leg portions being positioned circumferentially between the side wall portions. The side wall portions 202 are preferably identical and each preferably eventually terminates in a manner forming an arcuate rim portion 206 that extends radially outward from the main outer surface 192 of the locking member 108. The rim portions 206 are configured such that they form coplanar upward facing bearing surfaces 208. Each of the side wall portions 202 of the locking member 108 also preferably comprises an extension member opening 210 that extends through the side wall portion from the main outer surface 192 of the locking member and into the primary opening 194 of the locking member.

Each leg portion 204 is preferably attached to the upper portion 200 of the locking member 108 by a relatively thin bridge portion 212. Additionally, each leg portion 204 forms an actuation portion 214 as it extends downward. Beneath the actuation portions 214, each leg portion 204 extends radially outward from the main outer surface 192 of the locking member 108 in a manner forming a cam portion 116. The cam portion 116 of each leg portion 204 is preferably T-shaped, as viewed from above, in a manner such that the radially outer most part of the cam portion is wider than the spacing between the side wall portions 202 of the locking member 108 and in a manner forming a pair of bearing surfaces 218. The upper and radially outer most portion of each cam portion 216 has a rounded edge that forms a cam surface 220. Each cam surface 220 preferably increases in radius from its middle toward its opposite longitudinal ends. Finally, an arched recess 222 preferably extends radially outward from the inner most part of each of the cam portions 216 and upward from the bottom surface 196 of the locking member 108.

The various components of the scribing tool 100, formed as described above, are preferably assembled by first assembling the locking member 108 to the upper portion 144 of the tile engagement member 106. This is done by inserting the top portion 200 of the locking member 108 upward through the central opening 154 of the upper portion 144 of the tile engagement member 106 until the bearing surfaces 208 of the side wall portions 202 of the locking member engage the recessed cylindrical rim 158 of the top portion of the tile engagement member. During this procedure, the leg portions 204 of the locking member 108 are preferably deflected toward each other and are preferably maintained in such a position while the extension member 104 is then inserted through the extension member openings 210 that extend through the side wall portions 202 of the locking member. The extension member 104 is inserted through the extension member openings 210 of the side wall portions 202 by inserting either of the longitudinal ends 128 of the extension member therethrough.

With the extension member 104 inserted through the openings 210 of the side wall portions 202, the leg portions 204 of the locking member 108 are then released and the lower portion 146 of the tile engagement member 106 is preferably then assembled to the upper portion 144 of the tile engagement member. This is preferably done by aligning the locking tabs 152 of the upper portion 144 with the openings 174 of the lower portion 146, and thereafter pressing the upper and lower portions together. As this occurs, the cam surfaces 168 of the locking tabs 152 of the upper portion 144 engage the openings 174 of the lower portion 146, causing the locking tabs to resiliently deflect radially inward toward each other. Eventually, the bottom of the frustoconical wall portion 148 of the upper portion 144 engages the top surface 176 of the lower portion 146, at which point the locking surfaces 166 of the locking tabs 152 are positioned beneath the locking surfaces 190 of the lower portion. This allows the locking tabs 152 to at least partially return to their undeflected relative positions. As such, the locking surfaces 166 of the locking tabs 152 of the upper portion 144 and the locking surfaces 190 of the lower portion 146 then are positioned such that they cooperate to secure the upper and lower portions to each other.

The next step of assembling the scribing tool 100 preferably comprises attaching the scribe member 102 to the extension member 104. This is preferably done by simply inserting the nub 126 of the attachment portion 112 of the scribe member 102 upward through the opening 138 of the attachment portion 136 of the extension member 104 from beneath the partial frustoconical surface 140 of the extension member. The tapered nature of the partial frustoconical surface 140 of the opening 138 of the extension member 104 causes the nub 126 of the scribe member 102 to eventually engage against the partial frustoconical surface, which causes the opening to resiliently expand. The slot portion 142 of the opening 138 facilitates this by increasing the ability of the opening to resiliently expand. Eventually, the nub 126 of the scribe member 102 passes above the top 130 of the extension member 104, thereby allowing the opening 138 of the extension member to at least partially return to its undeflected configuration. However, the diameter of the column 124 of the attachment portion 112 of the scribe member 102 is preferably dimensioned to be slightly larger than the upper end of the partial frustoconical surface 140 of the extension member 104 such that the opening presses against the column and thereby creates friction. Nonetheless, with the nub 126 of the scribe member 102 positioned above the top 130 of the extension member 104 and the opening 138 of the extension member at least partially returned to its undeflected configuration, the nub then prevents the attachment portion 112 of the scribe member from moving downward relative to the extension member and thereby secures the scribe member to the extension member.

Having attached the various components of the scribing tool 100 to each other as recited above, the assembly of the scribing tool is then complete. As assembled, the scribe member 102 is pivotally connected to the extension member 104 about the center axis of the column 124 of the attachment portion 112 of the scribe member, but is otherwise rigidly connected thereto. However, pivotal movement of the scribe member 102 relative to the extension member 104 is frictionally inhibited by the friction between opening 138 of the extension member and the column 124 of the scribe member. As such, a torque in excess of a threshold amount is required therebetween to allow such pivotal movement. Thus, with an applied force, the scribe member 102 can be pivotally repositioned relative to the extension member 104, where it will remain unless intentionally repositioned.

Figure 23:
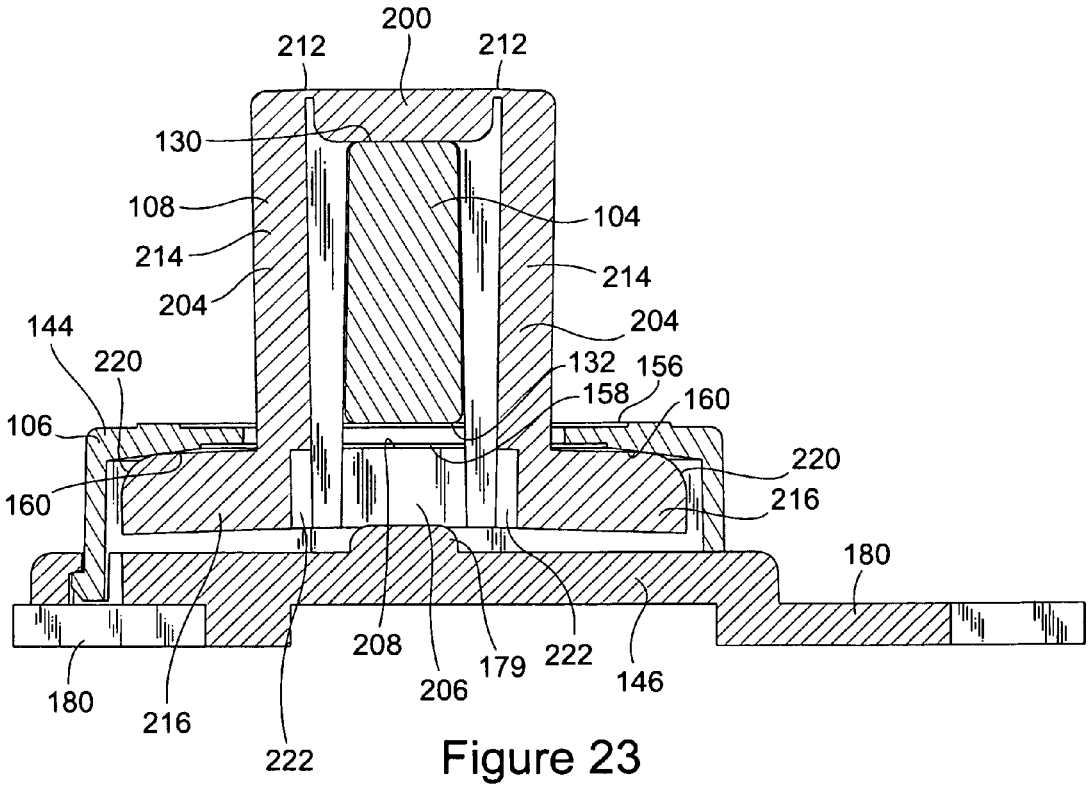
FIG. 23 is a cross-sectional view of the assembly shown in FIG. 22, taken about the line 23-23 shown in FIG. 22, and is shown with the locking member in its locking configuration.

The tile engagement member 106 of the scribing tool 100 is both pivotally and slideably connected to the extension member 104. However, the tile engagement member 106 is also frictionally lockable in position relative to the extension member 104 via the locking member 108. In particular, a force must be exerted on the locking member 108 to allow the tile engagement member 106 to pivotally and slideably move relative to the extension member 104. As shown in FIG. 23, absent an applied force, the locking member 108 preferably locks the extension member 104 relative to the tile engagement member 106 by forcing the extension member downward against the tile engagement member. In particular, the locking member 108 is preferably dimensioned such that the cam surfaces 220 of its leg portions 204 engage against the sloped cam surface 160 of the top wall portion 150 of the lower portion 144 of the tile engagement member 106 when not manually deflected. Thus, the biasing force that causes the leg portions 204 of the locking member 108 to resiliently deflect away from each other also forces the locking member downward relative to the tile engagement member 106. This movement causes the upper portion 200 of the locking member 108 to engage against the top 130 of the extension member 104 and thereby force the extension member downward until the bottom 132 of the extension member presses against the raised annular rim 156 of the upper portion 144 of the tile engagement member 106. As such, the extension member 104 becomes frictionally locked, both slideably and rotationally, to the tile engagement member 106.

Figure 24:
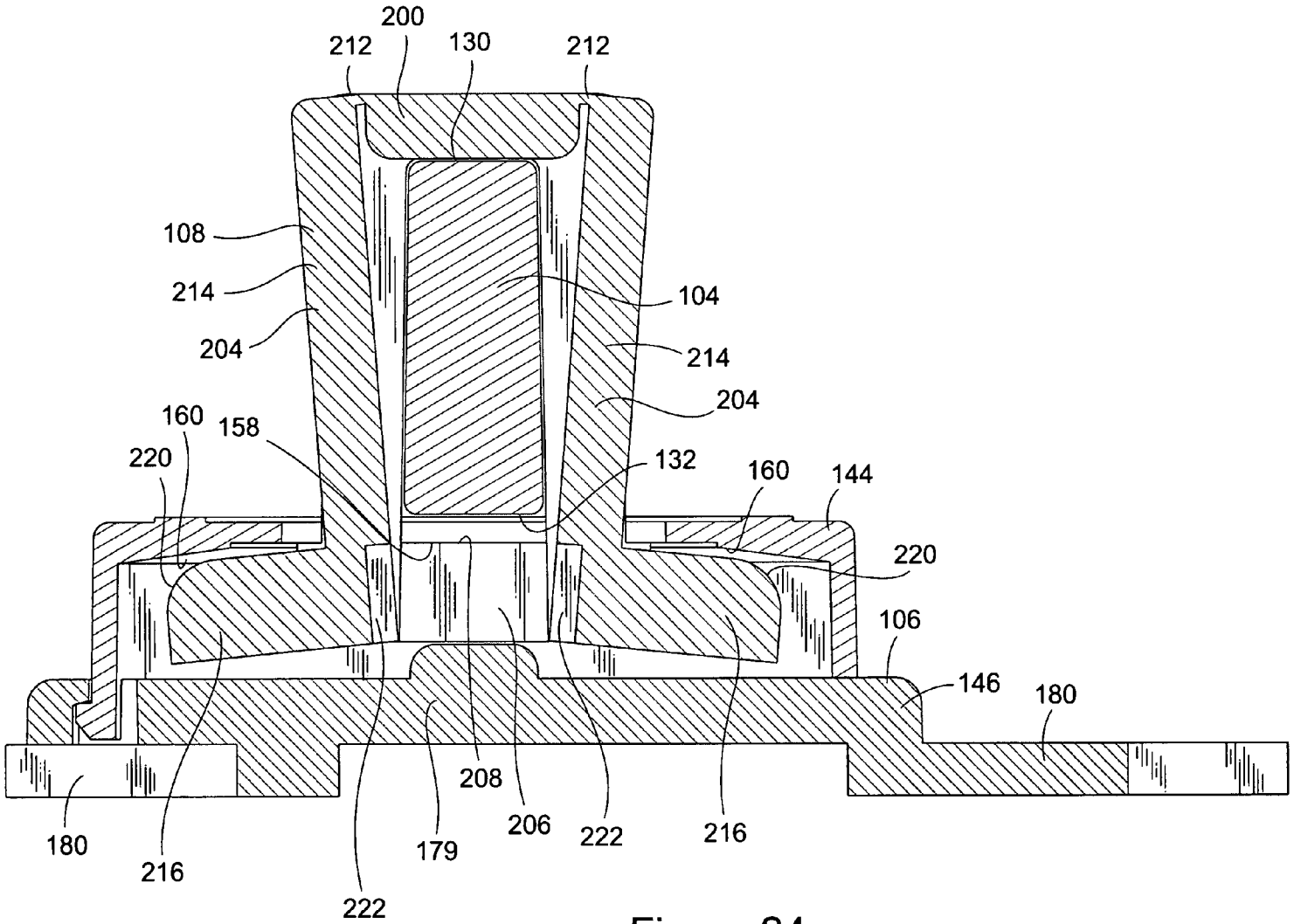
FIG. 24 is a cross-sectional view similar to the view of FIG. 23, but with the locking member in its unlocking configuration.

When desired, the extension member 104 can be moved, both slideably and rotationally, relative to the tile engagement member 106. This is done by simply manually exerting a squeezing force on the actuation portions 214 of the leg portions 204 of the locking member 108. This causes bending moments about the bridge portions 212 that connect the leg portions 204 to the upper portion 200 of the locking member 108, which then resiliently deflect and thereby allow the leg portions to pivot thereabout. When a sufficient force is applied, the leg portions 204 are deflected toward each other as shown in FIG. 24. Excessive deflection of the leg portions 204 toward each other is prevented by the bearing surfaces 218 on the cam portions 216 of the leg portions 204, which engage against the rim portions 206 of the side wall portions 202 of the locking member 108. This prevents the leg portions 204 from clamping the extension member 104 therebetween.

With the leg portions 204 of the locking member 108 deflected as shown in FIG. 24, the cam surfaces 220 of the locking member are disengaged with the sloped cam surface 160 of the upper portion 144 of the tile engagement member 106. This allows the locking member 108 to move upward relative to the tile engagement member 106, at least until the bearing surfaces 208 of the side wall portions 202 of the locking member engage against the recessed annular rim 158 of the upper portion 144 of the tile engagement member. By moving upward relative to the tile engagement member 106, the distance between the upper portion 200 of the locking member 108 and the raised annular rim 156 of the tile engagement member becomes slightly greater than the distance between the top 130 and bottom 132 of the extension member 104. As such, the extension member 104 is no longer clamped against the tile engagement member 106 by the locking member 108 and is therefore free to slideably move relative to both the tile engagement member and the locking member. Additionally, the extension member 104 and the locking member 108 are then able to pivot together relative to the tile engagement member 106. Thus, simply by squeezing the actuation portions 214 of the locking member 108 toward each other, the scribe member 102 of the scribing tool 100 can be moved toward or away from the tile engagement member 106 and can be simultaneously pivoted thereabout.

Upon releasing the locking member 108, the leg portions 204 resiliently deflect away from each other, causing the cam surfaces 220 of the locking member to once again engage the sloped cam surface 160 of the upper portion 144 of the tile engagement member 106. As a result of such engagement, the locking member 108 is forced downward relative to the tile engagement member 106, and thereby once again clamps the extension member 104 against the tile engagement member.

It should be appreciated that, over time, the resiliency of the locking member 108 may decrease. As such, the scribing tool 100 is configured such that a compression spring (not shown) can be added to the assembly to provide additional biasing force that further acts to move the leg portions 204 of the locking member 108 away from each other. In particular, the locking member 108 is configured such that a helical compression spring can easily be longitudinally positioned between the arched recesses 222 of the leg portions 204 in a semi-compressed state. It should also be appreciated that the arched recesses 222 of the leg portions 204 will limit the horizontal and upward movement of such a spring and that the draft angles associated with the locking member 108 will tend to bow the spring downward. However, the nub portion 179 of the lower portion 146 of the tile engagement member 106 is configured to engage the spring so as to prevent it from being downwardly dislodged. Moreover, the nub portion 179 is configured to be relatively small in diameter such that it only minimally adds frictional resistance to the relative rotational movement between the tile engagement member 106 and the locking member 108 when the locking member is in its unlocked configuration.

An example of the use of the scribing tool 100 is depicted in FIGS. 25 and 26. The exemplarily use of the scribing tool 100 shown in FIGS. 25 and 26 assumes that first 300 and second 302 tiles have been attached to a surface 304 where they define a space 306 therebetween on which a trimmed or cut tile is sought to be placed. The space 306 is partially bound by a straight edge 308 of the first tile 300, a straight edge 310 of the second tile 302, and a portion of a boundary perimeter 312. As shown, the portion of the boundary perimeter 312 is a portion of floorboard trim 314 that extends perpendicular to the surface 304 being tiled. However, it should be appreciated that the portion of the boundary perimeter 312 could be any desired boundary to which a tile placed in the space is desired to extend.

The scribing process preferably begins by aligning the straight edge 122 of the scribe member 102 of the scribing tool 100 with the boundary perimeter 312 that partially defines the space 306 onto which a tile is sought to be placed. Once aligned, the person using the scribe tool 100 holds the scribe member 102 in place with one hand, while using his or her other hand to squeeze the actuation portions 214 of the locking member 108 toward each other. With the actuation portions 214 squeezed and the scribe member 102 held in place as described, the tile engagement member 106 is then free to slide and pivot relative to the extension member 104. The person using the scribing tool 100 then preferably slides the locking member 108 and tile engagement member 106 toward the projected intersection of the straight edges 308, 310 of the first 300 and second tiles 302. As this occurs, it may be necessary to pivot the extension member 104 relative to the scribe member 102, which is achieved by merely exerting an uneven force sufficient to create a torque that overcomes the threshold moment required to pivot the scribe member relative to the extension member. Additionally, during this step, the first 182 and second 184 engagement portions of the lower portion 146 of the tile engagement member 106 engage against the straight edges 308,310 of the first 300 and second 302 tiles, respectively. Because the tile engagement member 106 is free to pivot relative the extension member 104 when this occurs, the legs 180 of the lower portion 146 of the tile engagement member 106 automatically align themselves with the straight edges 308,310 of the first 300 and second 302 tiles, as shown in FIG. 25, when they engage such edges. By configuring the tile engagement member 106 such that the legs 180 of the lower portion 146 of the tile engagement member 106 extend beyond the main body 170 of the lower portion, the proper alignment of the tile engagement member 106 with the edges 308,310 of the first and second tiles can be visually verified.

With the above mentioned step complete, the person using the scribing tool 100 then preferably simply releases the scribe member 102 and the locking member 108, thereby locking the scribe member and the tile engagement member 106 in their relative position. Then, the person using the scribing tool 100 preferably positions the scribing tool above a yet to be placed or cut third tile 316, as shown in FIG. 26, while holding the extension member 104. During this step, the bottom 118 of the scribe member 102 and the bottom surface 178 of the lower portion 146 of the tile engagement member 106 are preferably engaged against the upper surface 318 of the third tile 316. Simultaneously, the person using the scribing tool 100 positions the scribing tool such that the third 186 and fourth 188 engagement portions of the legs 180 of the tile engagement member 106 engage and align with the first 320 and second 322 edges of the third tile 316, respectively. With the scribing tool 100 so placed, the person using the scribing tool then preferably firmly presses the scribe member 102 against the third tile 316 and cuts through or scribes a line on the third tile via a marking utensil or a cutting device, such as a blade. The scribing tool is then removed from the third tile 316 and the procedure may be repeated, such as when complex or multiple boundary perimeters 312 require multiple scribing. Finally, all unwanted portions of the third tile 316 are then cut away or otherwise removed from the third tile using conventional techniques.

Having completed the above-mentioned steps, the third tile 316 has the desired shape to be attached to the space 306 on the surface 304. Moreover, the spacing between the first 182 and third 186 engagement portions and between the second 184 and fourth 188 engagement portions of the tile engagement member 106 is preferably configured to be equal to the desired grout width between the laid tile. As such, when the third tile 316 is properly positioned against the portion of the boundary perimeter 312, it is also positioned the proper grout width from each of the first 300 and second 302 tiles.

Figure 27:
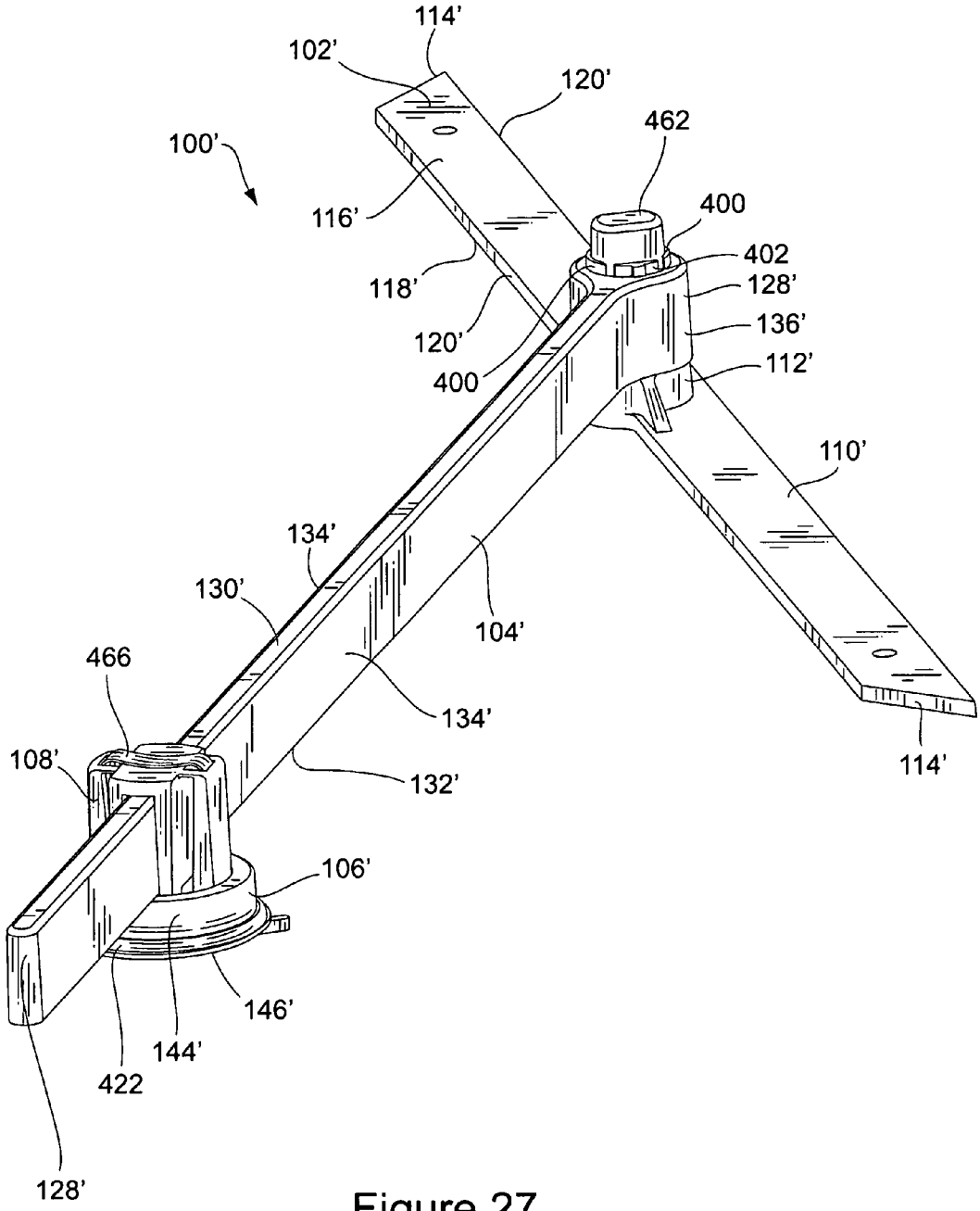
FIG. 27 is a perspective view of a second embodiment of a scribing tool in accordance with the invention, as seen from above the scribing tool.
Figure 28:
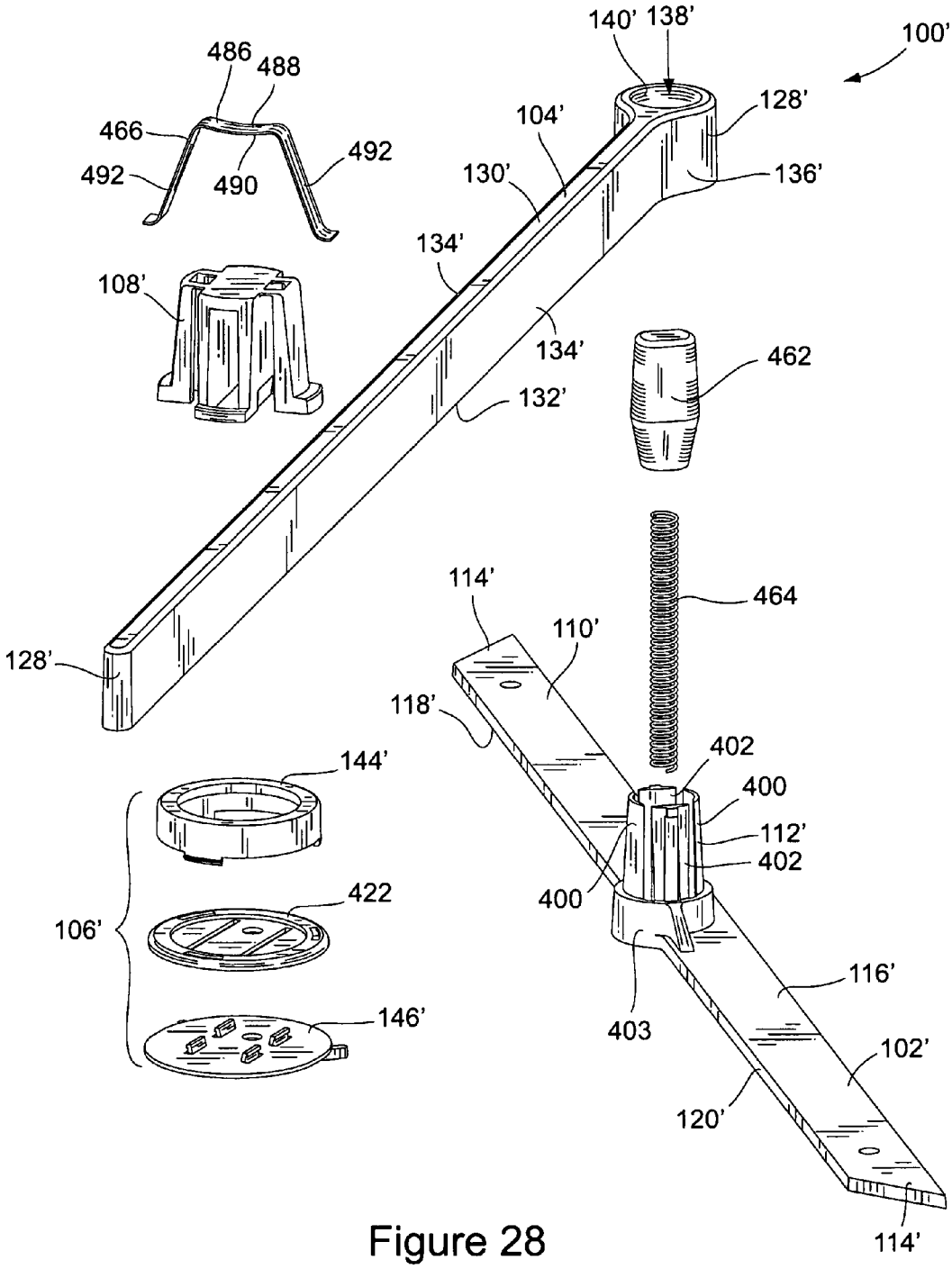
FIG. 28 is an exploded perspective view of the scribing tool shown in FIG. 27.
Figure 29:
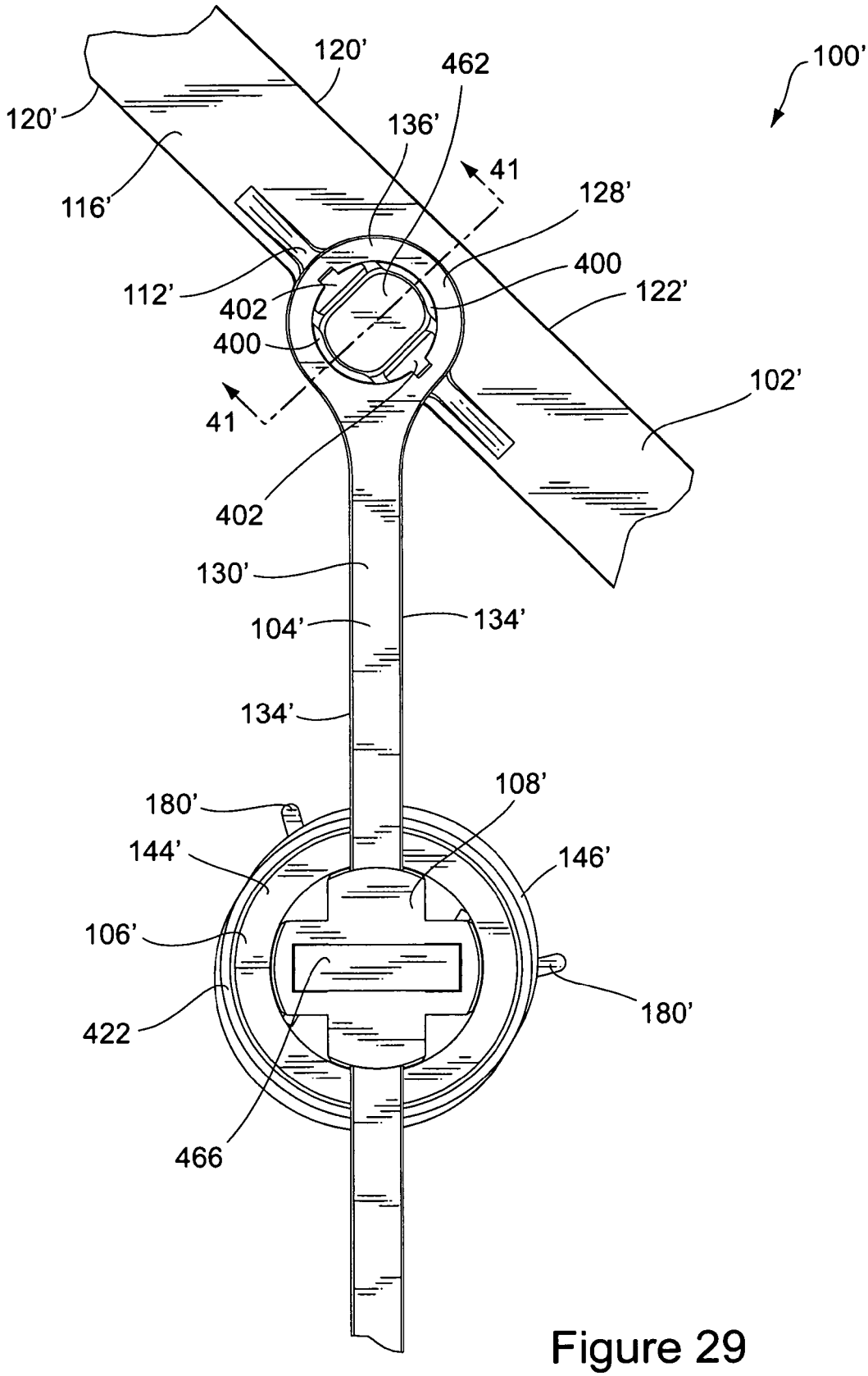
FIG. 29 is a partial top view of the scribing tool shown in FIG. 27.
Figure 30:
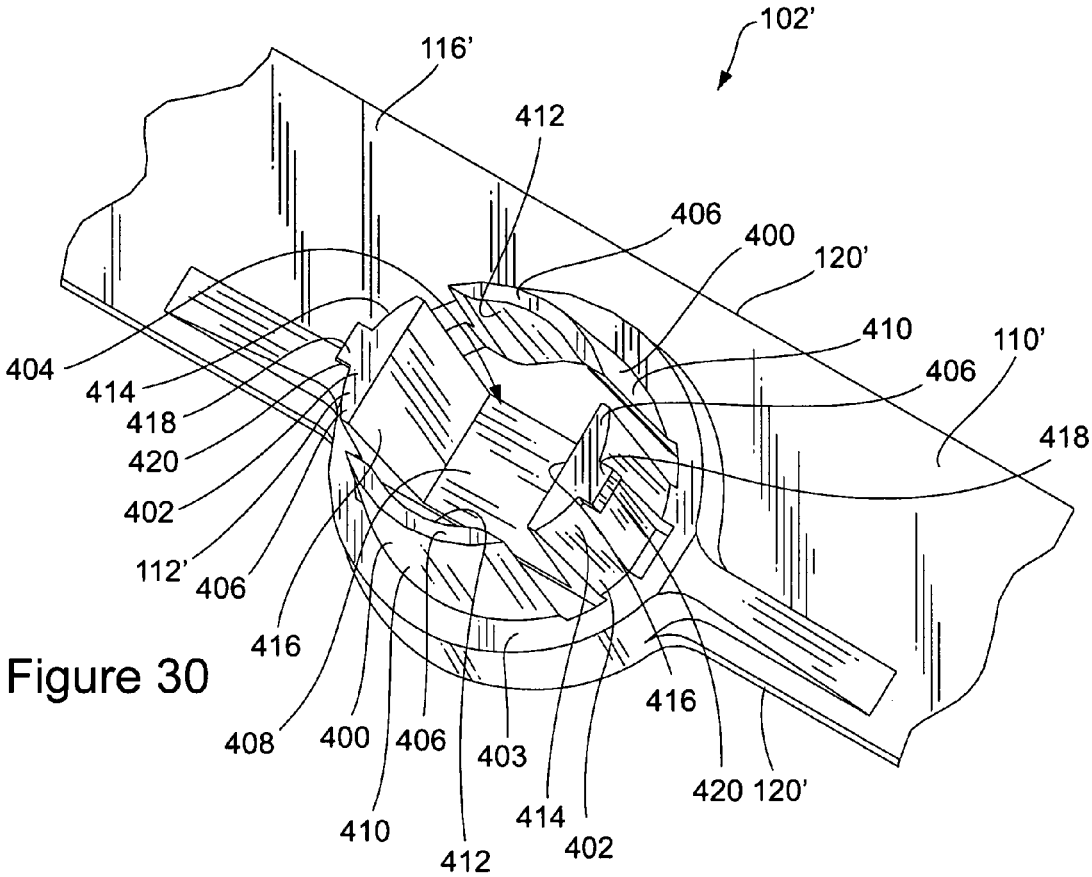
FIG. 30 is a partial perspective view of the scribe member of the scribing tool shown in FIG. 27, as seen from above the scribe member.
Figure 31:
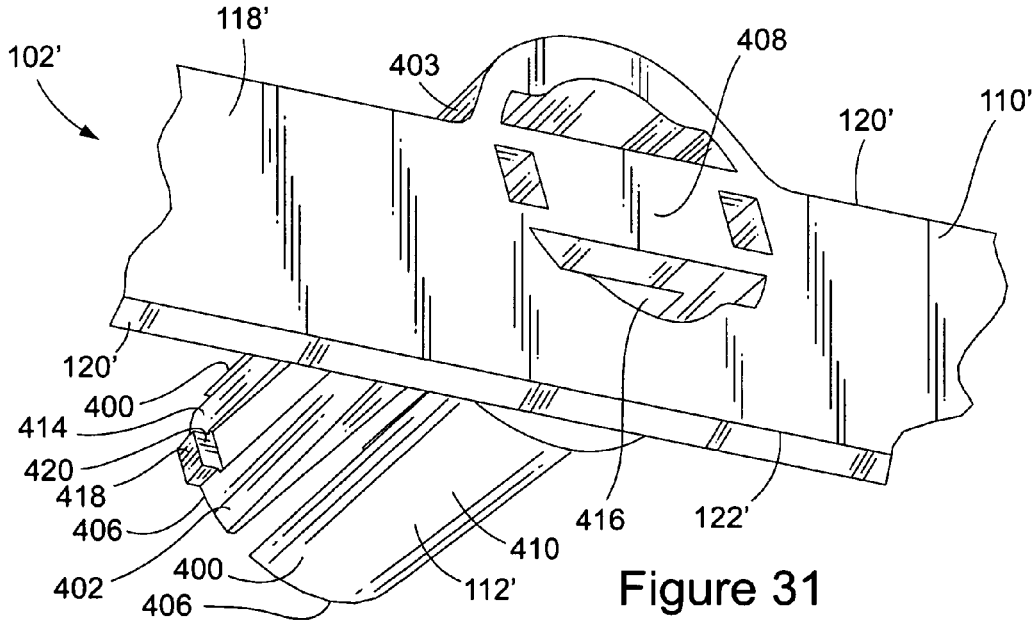
FIG. 31 is a partial perspective view of the scribe member shown in FIG. 30, as seen from beneath the scribe member.
Figure 32:
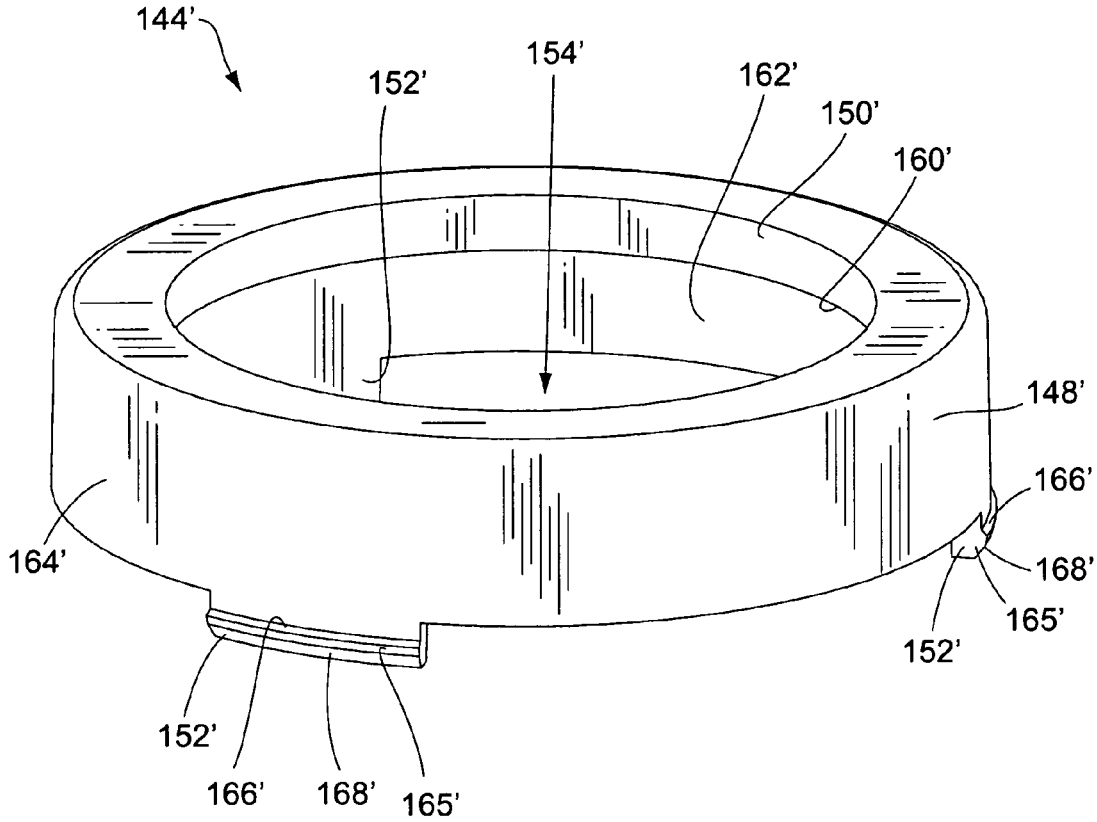
FIG. 32 is a perspective view of the upper portion of the tile engagement member of the scribe member of the scribing tool shown in FIG. 27.
Figure 33:
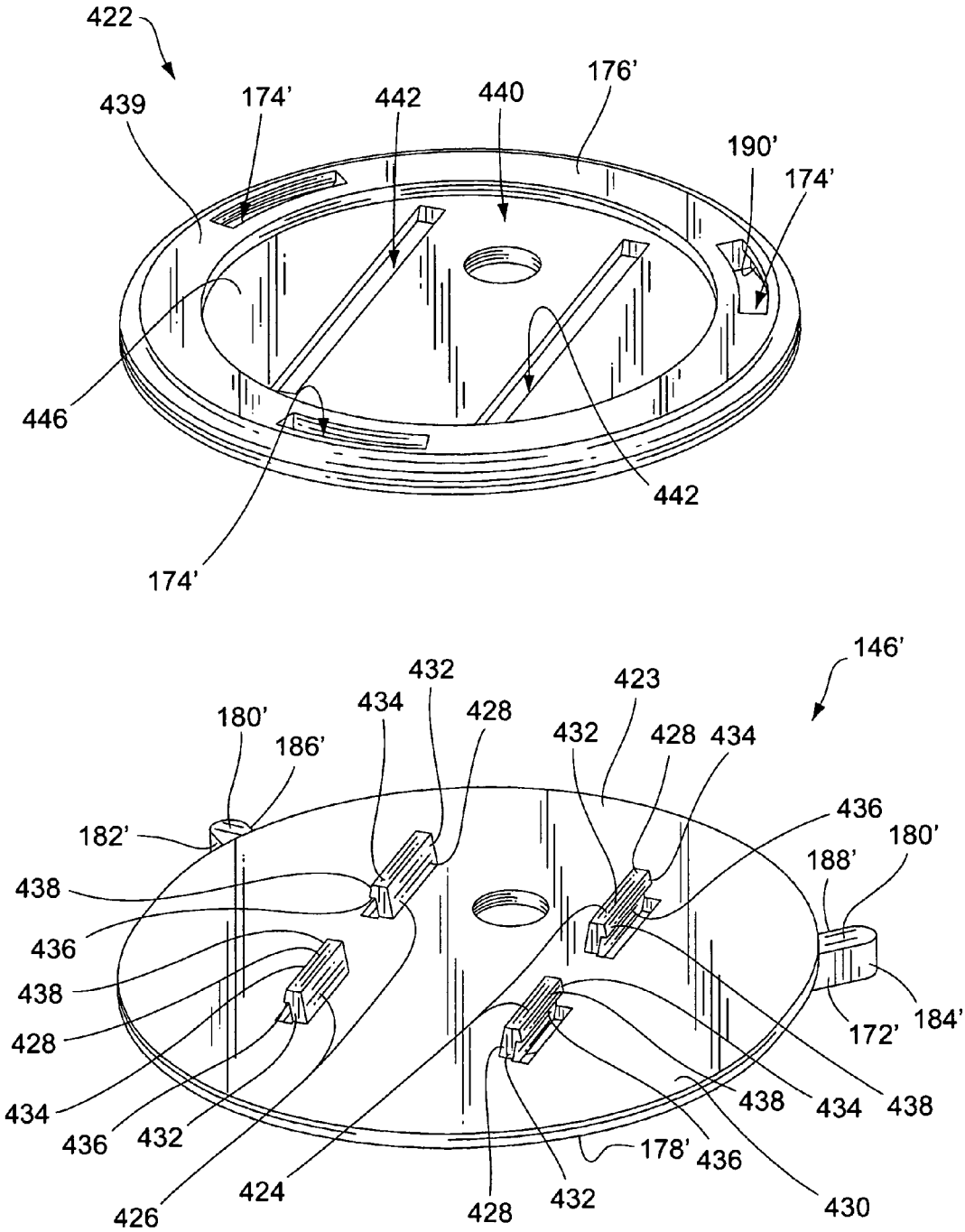
FIG. 33 is an exploded perspective view of the lower and intermediate portions of the tile engagement member of the scribing tool shown in FIG. 27, as seen from above the assembly.
Figure 34:
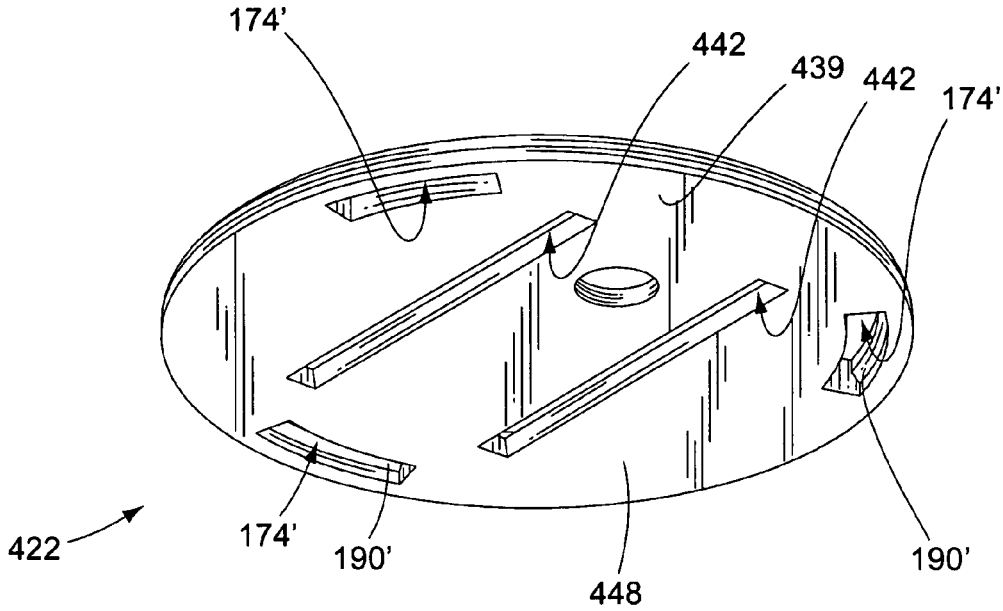
FIG. 34 is an exploded perspective view of the lower and intermediate portions of the tile engagement member of the scribing tool shown in FIG. 27, as seen from beneath the assembly.
Figure 34:
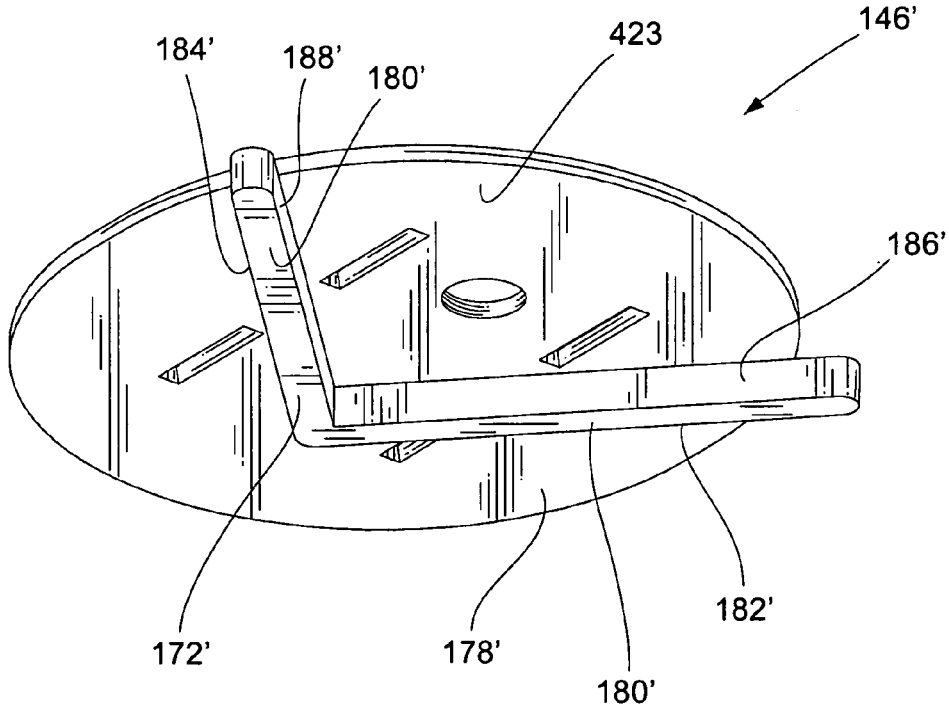

A second embodiment of a scribing tool 100' in accordance with the invention is shown in its entirety in FIGS. 27 and 28. Several views of the components of scribing tool 100' of the second embodiment are also shown FIGS. 29-41. Although the scribing tool 100' of the second embodiment does comprise several components not present in the first embodiment, many of the components are similar to the scribing tool 100 of the first embodiment. For example, the scribing tool 100' comprises a scribe member 102', an extension member 104', a tile engagement member 106', and a locking member 108'. Each of these components preferably functions in a manner similar to those of the first embodiment, except for a few differences that are hereinafter described or that are otherwise apparent from the drawing figures. It should be appreciated that, like the scribing tool 100 of the first embodiment, most of the components of the scribing tool 100' of the second embodiment are configured and adapted to be molded as monolithic pieces formed out of plastic or metal via one or more two-part molds. Each reference numeral shown in FIGS. 27-41 that is followed by a prime mark corresponds to an aspect of the scribing tool 100' of the second embodiment that is similar in function or purpose to the aspect of the scribing tool 100 of the first embodiment that is represented in FIGS. 1-26 by the same numeral without the prime mark. Thus, the description of such aspects in reference to the scribing tool 100 of the first embodiment generally apply to the corresponding aspects of the scribing tool 100' of the second embodiment.

The scribe member 102' of the scribing tool 100' of the second embodiment has an attachment portion 112' that is appreciably distinguishable from the attachment portion 112 of the scribe member 102 of the first embodiment. Rather than comprising a column and nub, the attachment portion 112' of the scribing tool 100' of the second embodiment comprises a pair of locking protrusions 400 separated circumferentially by a pair of capture protrusions 402 that extend upwardly from an annular rib 403. A cavity 404 extends downward between the locking protrusions 400 and the capture protrusions 402 from the top surfaces 406 of the locking protrusions and the capture protrusions to a base portion 408 that spans between the pair of capture protrusions. Each of the locking protrusions 400 comprises a partial frustoconical outer surface 410 and an inner surface 412. The frustoconical outer surfaces 410 of the locking protrusions 400 share a common axis. The inner surfaces 412 of the locking protrusions 400 are each partial cylindrical surfaces that incline in a manner such that they extend away from each other as they extend downward. Each of the capture protrusions 402 has a partial frustoconical outer surface 414, a planar inner surface 416, and a capture tab 418. The outer surfaces 414 of the capture protrusions 402 share a common axis with each other and with the outer surfaces 410 of the locking protrusions 400. The inner surfaces 416 are perpendicular to a common plane and taper toward each other as they extend downward. The capture tabs 418 extend away from each other and generally over the outer surfaces 414 of the capture protrusions 402 adjacent the top surfaces 406 of the capture protrusions. As such, the capture tabs 418 create downward facing horizontal capture surfaces 420 that extend beyond the outer surfaces 414 of the capture protrusions 402.

The extension member 104' of the scribing tool 100' of the second embodiment differs only slightly from the extension member 104 of the scribing tool 100 of the first embodiment. In particular, the extension member 104' of the second embodiment is devoid of the slot portion 142 of the extension member 104 of the first embodiment. Thus, the frustoconical surface 140' of the opening 138' of the extension member 104' of the second embodiment forms a complete frustoconical surface. Additionally, the frustoconical surface 140' of the second embodiment is larger in diameter than is the frustoconical surface 140 of the first embodiment and, as such, the sides 134' of the extension member 104' bulge out around the opening 138' as they extend circumferentially therearound.

The tile engagement member 106' of the scribing tool 100' of the second embodiment is shown comprising separate upper 144', lower 146', and intermediate 422 portions. The upper portion 144' of the tile engagement 106' member of the second embodiment, although slightly different from the upper portion 144 of the tile engagement member 106 of the first embodiment, is preferably completely compatible with the lower portion 146 of the first embodiment. Similarly, the lower 146' and intermediate 422 portions of the tile engagement member 106' of the second embodiment are collectively completely compatible with the upper portion 144 of the tile engagement member 106 of the first embodiment. However, the lower 146' and intermediate 422 portions of the tile engagement member 106' of the second embodiment are configured for use when tiles are to be laid edge-to-edge (i.e., without any grout therebetween).

The upper portion 144' of the tile engagement 106' member of the second embodiment differs from the upper portion 144 of the tile engagement 106 member of the first embodiment in a few minor ways. These differences exist primarily to accommodate the differences between the locking member 108' of the second embodiment and the locking member 108 of the first embodiment or to simplify the configuration of the upper portion 144'. Notably, the primary opening 194' of the upper portion 144' has a larger diameter than that of the first embodiment. Additionally, the cam surface 160' of the top wall portion 150' of the upper portion 144' of the second embodiment is planar rather than frustoconical. Finally, the upper portion 144' of the second embodiment is devoid of both the raised annular rim 156 and the recessed annular rim 158 of the upper portion 144 of the tile engagement member 106 of the first embodiment. Thus, the cam surface 160' of the top wall portion 150' of the upper portion 144' of the second embodiment extends to the central opening 154' of the upper portion.

The lower portion 146' of the scribing tool 100' of the second embodiment has a bottom surface 178' and an L-shaped protrusion 172' that are similar to the bottom surface 178 and the L-shaped protrusion 172 of the lower portion 146 of the scribing tool 100 of the first embodiment. However, the main body 423 of the lower portion 146' is preferably oval in shape and is thinner than the lower portion 146 of the scribing tool 100 of the first embodiment. Additionally, the lower portion 146' lacks the nub portion 179 and openings 174 of the lower portion 146 of the scribing tool 100 of the first embodiment. Still further, the lower portion 146' comprises first 424 and second 426 pairs of protrusions 428 that extend upward from the upper surface 430 of the main body 423. Each protrusion 428 preferably forms a guide rail 432 as it extends upward from the upper surface 430 of the main body 423 and preferably forms a barb 434 that extends horizontally from the guide rail. Each barb 434 preferably comprises a locking surface 436 and a cam surface 436. The locking surface 436 of each barb 434 is spaced from the upper surface 430 of the main body 423. Preferably, the guide rails 432 of the first 424 pair of protrusions 428 are aligned with each other, as are the guide rails of the second 426 pair of protrusions. The guide rails 432 of the first 424 and second 426 pair of protrusions 428 are preferably parallel to each other and parallel to the plane of symmetry of the L-shaped protrusion 172' of the lower portion 146'. Finally, openings 436 extend through the main body 423 beneath the barbs 430 of the protrusions 424 to facilitate the fabrication of the lower portion 146' via a two-part mold.

The intermediate portion 422 of the tile engagement member 106' of the second embodiment also comprises several features present on the lower portion 146 of the tile engagement member 106 of the first embodiment. For example, the intermediate portion 422 comprises a similar top surface 176' and similar openings 174' that have similar locking surfaces 190'. The main body 439 of the intermediate portion 422 is also preferably discoidal. However, intermediate portion 422 of the tile engagement member 106' of the second embodiment also comprises some features that are not present on the lower portion 146 of the tile engagement member 106 of the first embodiment. Notably, a circular recess 440 is preferably centrally formed in the top surface 176' of the intermediate portion 422. Additionally, two linearly elongated openings 442 preferably extend parallel to each other through the main body 439 from the upper surface 446 of the recess 440 to the bottom surface 448 of the intermediate portion 422.

The locking member 108' of the scribing tool 100' of the second embodiment differs from the locking member 108 of the first embodiment in several ways, but functions similarly and serves the same purpose. Notably, the locking member 108 of the second embodiment comprises a main outer surface 192', a primary opening 194', a bottom surface 196', a top surface 198', an upper portion 200', side wall portions 202', leg portions 204', rim portions 206', bearing surfaces 208' that are generally fixed to the rim portions, an extension member opening 210', bridge portions 212', actuation portions 214', cam portions 216', bearing surfaces 218' on the cam portions of the leg portions, and cam surfaces 220'. These features function similar to and serve generally the same purpose as those of the locking member 108 of the first embodiment.

Figure 37:
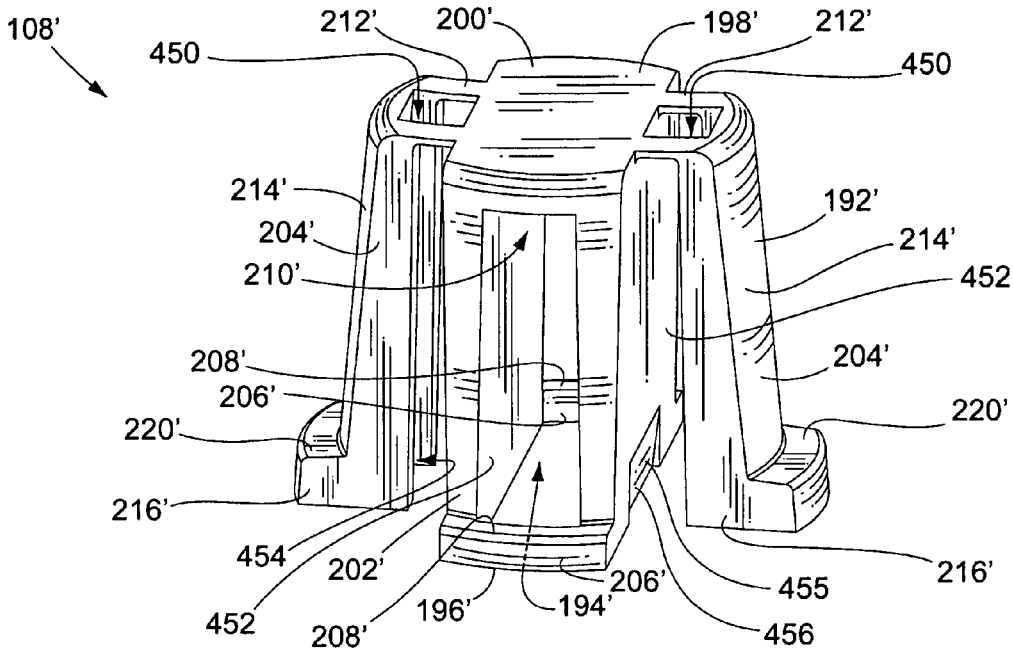
FIG. 37 is a perspective view of the locking member of the scribing tool shown in FIG. 27, as seen from above the locking member.
Figure 38:
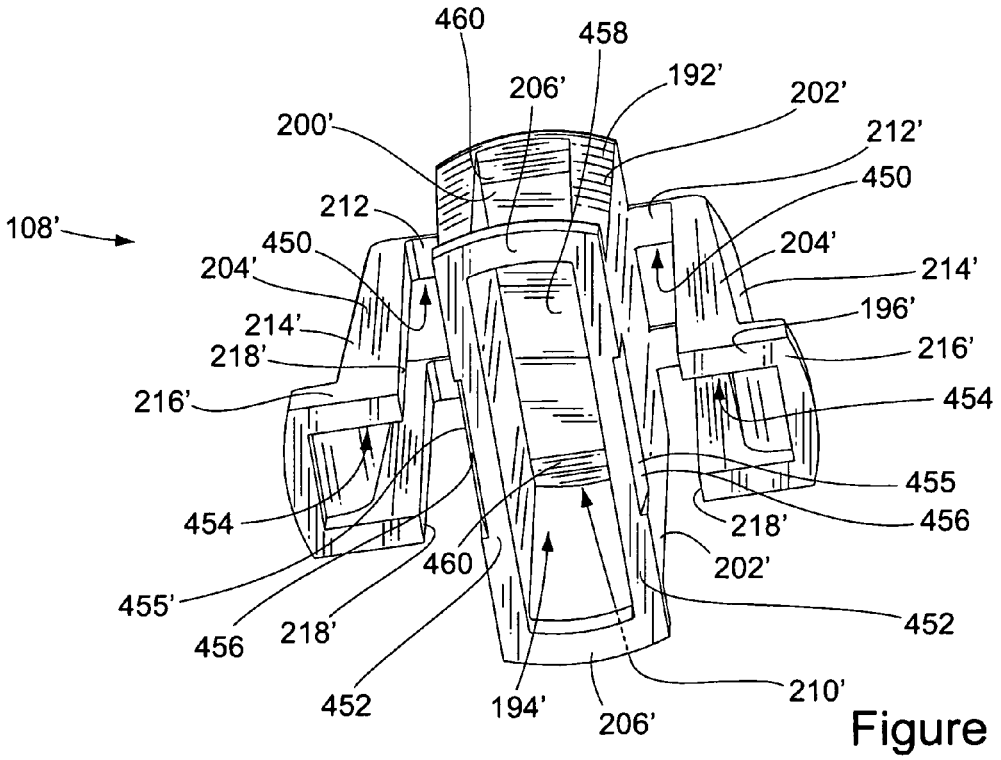
FIG. 38 is a perspective view of the locking member shown in FIG. 37, as seen from beneath the locking member.
Figure 39:
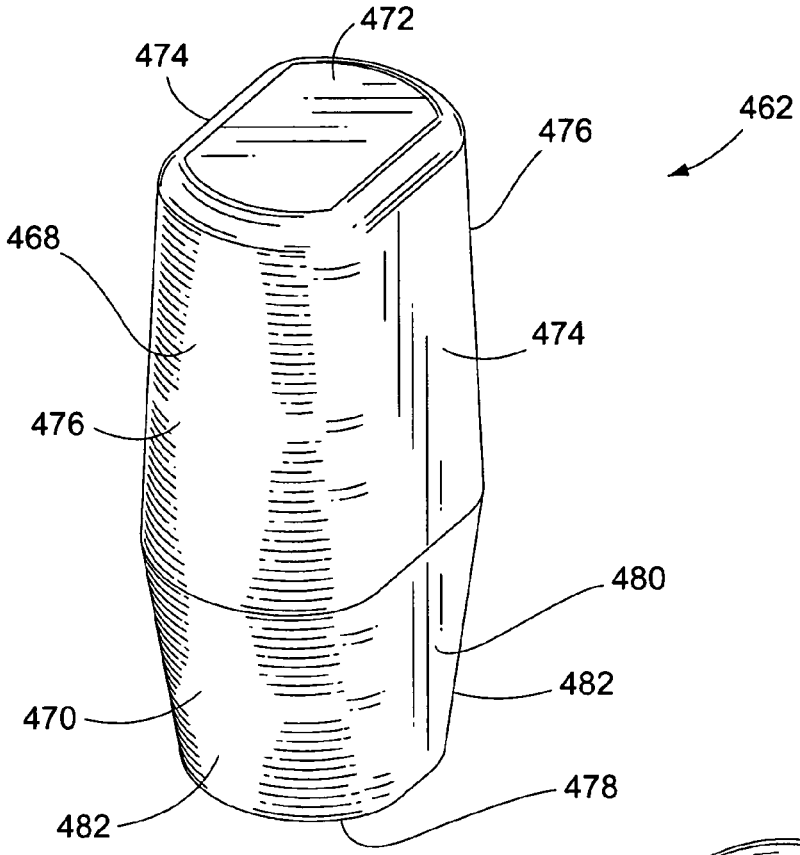
FIG. 39 is a perspective view of the release member of the scribing tool shown in FIG. 27, as seen from above the release member.
Figure 40:
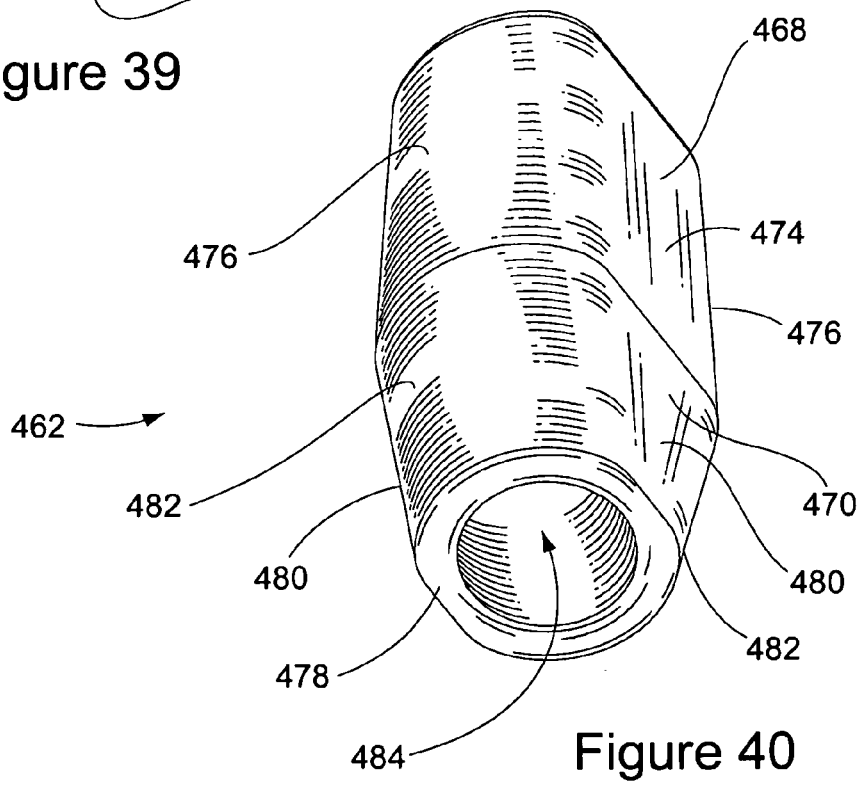
FIG. 40 is a perspective view of the release member of the scribing tool shown in FIG. 27, as seen from beneath the release member.

The locking member 108' of the second embodiment does differ from the locking member 108 of the first embodiment in several ways, primarily for producability reasons and to increase the useful life of the scribing tool 100', but is otherwise generally the same. Notably, and as shown in FIGS. 37 and 38, the locking member 108' preferably comprises two openings 450, one of which extends through one of the bridge portions 212' and the other of which extends through the other of the bridge portions. Additionally, a pair of rib or web portions 452 preferably extend between the side wall portions 202' of the locking member 108'. The locking member 108' also comprises channels 454 formed in the leg portions 204' beneath the openings 450. The channels 454 preferably flare apart from each other when the reach the cam portions 216' of the leg portions 204' and preferably extend beneath the cam surfaces 220' of the cam portions. A pair of bearing surfaces 455 are preferably formed by recesses 456 that extend into the web portions 452. These bearing surfaces 455 engage against the bearing surfaces 218' of the leg portions 204' when the leg portions are squeezed toward each other and thereby prevent the extension member 104' from being squeezed by the leg portions. The interior surface 458 beneath the upper portion 200' preferably bulges downward into primary opening 194' and has rounded edge portions 460 that are tangent to the lower most portion of the interior surface. The rounded edge portions 460 reduce the likelihood that the extension member 104' and the locking member 108' will bind with each other when such components are being slideably moved relative to each other.

In addition to the foregoing, the scribing tool 100' of the second embodiment preferably comprises a release member 462, a compression spring 464, and a torsion spring 466. Like the above mentioned components of the scribing tool 100', the release member 462 is preferably a formed as a monolithic piece of plastic via a two-part mold. The release member 462 has an upper portion 468 and a lower portion 470. The upper portion 468 of the release member 462 preferably comprises a planar top surface 472, planar side surfaces 474, and partial cylindrical front and back surfaces 476. The planer side surfaces 474 preferably taper toward each other as they extend toward the top surface 472 to create a draft for molding. The front and back surfaces 476 each incline in a manner such that they extend away from each other as they extend downward relative to the top surface 472. The lower portion 470 of the release member 462 preferably comprises a planar bottom surface 478, planar side surfaces 480, and partial frustoconical front and back surfaces 482. The planar side surfaces 480 of the lower portion preferably taper toward each other as they extend down to the bottom surface 478 to create a draft for molding. Likewise, the front and back surfaces 482 of the lower portion 470 preferably taper toward each other as they extend down from the front and back surfaces 476 of the top portion 468. A blind hole 484 preferably extends upward into the release member 462 from the bottom surface 478, and terminates short of the top surface 472 of the upper portion 468. The blind hole 484 preferably has a frustoconical shape to create a draft for molding.

The compression spring 464 is a preferably a standard off-the-shelf coil spring formed of spring steel or stainless steel. Similarly, the torsion spring 466 is preferably formed out of hardened spring steel or stainless steel. However, the torsion spring 466 is preferably die formed out of strip material and is preferably specially adapted for use with the scribing tool 100'. The torsion spring 466 has center portion 486 with a concave upper surface 488 and a convex lower surface 490, and opposite leg portions 492. The leg portions 492 of the torsion spring 466 are preferably symmetric and preferably extend apart from each other as they extend, downward from the center portion 486 of the torsion spring. The lowermost portions of the leg portions 492 preferably flare apart as shown in FIG. 28.

The scribing tool 100' of the second embodiment is assembled in a manner generally similar to the scribing tool 100 of the first embodiment. For example, the locking member 108' is inserted upwardly through the central opening 154' of the upper portion 144' of the tile engagement member 106'. Additionally and thereafter, the end of the extension member 104' opposite the attachment portion 136' of the extension member is inserted through the extension member opening 210' of the locking member 108'. Still further, the attachment portion 112' of the scribe member 102' is inserted upwardly through the attachment portion 136' of the extension member 104'.

However, prior to inserting the attachment portion 112' of the scribe member 102' upwardly through the attachment portion 136' of the extension member 104', the compression spring 464 is inserted into the blind hole 484 of the release member 462. The compression spring 464 and the release member 462 are then inserted downwardly into the cavity 404 of the scribe member 102'. This is performed with the side surfaces 480 of the lower portion 470 of the release member 462 facing the inner surfaces 416 of the capture protrusions 402 of the scribe member 102', and proceeds until the bottom surface 478 of the release member engages the base portion 408 of the scribe member. As this occurs, the compression spring 464 compresses and the front and back surfaces 482 of the lower portion 470 of the release member 462 engage with the inner surfaces 412 of the locking protrusions 400 of the scribe member 102' and cause the locking protrusions to resiliently deflect apart from each other. The frustoconical configuration of the front and back surfaces 482 of the lower portion 470 of the release member 462 allows the release member to be partially inserted into the cavity 404 of the scribe member 102' without the need for any such deflection and thereafter allows such deflection to be progressive as the release member is further inserted into the cavity. The configuration of the release member 462 is such that, when the bottom surface 478 of the release member 462 is engaged with the base portion 408 of the scribing member 102', the release member is disengaged with the inner surfaces 412 of the locking protrusions 400 of the of the scribe member 102'. Thus, when the bottom surface 478 of the release member 462 is in close proximity to the base portion 408 of the scribe member 102', the locking protrusions 400 of the scribe member resiliently deflect back to their original configuration.

With the release member 462 forcibly held in engagement with the base portion 408 of the scribe member 102' against the compression force generated by the compression spring 464, the attachment portion 112' of the scribe member is inserted upwardly through the opening 138' of the attachment portion 136' of the extension member 104' until the bottom 132' of the extension member engages against the annular rib 403 of the attachment portion of the scribe member. As this occurs, the capture tabs 418 of the capture protrusions 402 of the scribe member 102' engage against the frustoconical surface 140' of the opening 138' of the extension member 104', and thereby cause the capture protrusions to resiliently deflect toward each other. It should be appreciated that the tapered configuration of the frustoconical surface 140' of the opening 138' of the extension member 104' allows capture protrusions 402 of the scribe member 102' to be initially inserted into the opening without any such deflection and thereafter allows such deflection to be gradual. Moreover, it should be appreciated that the release member 462 is dimensioned and configured to allow space for the capture protrusions 402 of the scribe member 102' to deflect toward each other while the release member is positioned in the cavity 404 of the scribe member. When the bottom 132' of the extension member 104' is engaged against the annular rib 403 of the attachment portion 112' of the scribe member 102', the capture tabs 418 are positioned above the top 130' of the extension member 104' and the capture protrusions 402 automatically resiliently deflect back to their original configuration. Once this occurs, the capture surfaces 420, which are then positioned directly above the top 130' of the extension member 104', prevent the removal of the attachment portion 112' of the scribe member 102' from the attachment portion 136' of the extension member 104' by engaging against the top surface of the extension member. Thereafter, the assembly of the scribe member 102' to the extension member 104' is complete and the applied force holding the release member 462' in engagement with the base portion 408 of the scribe member 102' can be removed.

Figure 42:
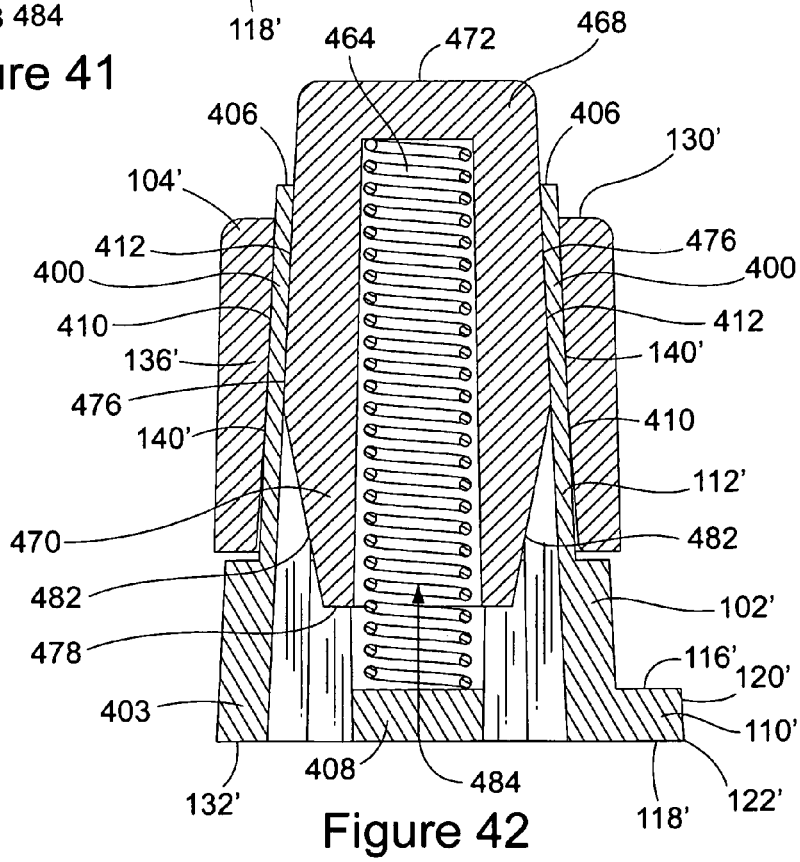
FIG. 42 is a cross-sectional view similar to the view of FIG. 41, but with the release member in the locked condition.

The removal of the applied force holding the release member 462' in engagement with the base portion 408 of the scribe member 102' causes the stored energy of the compression spring 464 to force the release member 462 upward. This causes the front and back surfaces 476 of the upper portion 468 of the release member 462 to engage against the inner surfaces 412 of the locking protrusions 400 of the attachment portion 112' of the scribe member 102' and thereby causes the locking protrusions to resiliently deflect apart from each other. However, after defecting slightly, the outer surfaces 410 of the locking protrusions 400 of the scribe member 102' engage against the frustoconical surface 140' of the opening 138' of the extension member 104'. Thereafter, the locking protrusions 400 become sandwiched between the frustoconical surface 140' of the opening 138' of the extension member 104' and the front and back surfaces 476 of the upper portion 468 of the release member 462. This prevents the release member 462 from further backing out of the cavity 404 of the scribe member 102' and results in the scribe member being fixed in position with respect to the extension member 104' (as shown in FIG. 42 and discussed further below).

At anytime after the extension member 104', the locking member 108', and the upper portion 144' of tile engagement member 106' of the scribing tool 100' have been assembled to each other, the intermediate portion 422 of the tile engagement member can be attached to the upper portion of the tile engagement member. This is done by snapping the locking tabs 152' of the upper portion 144' of the tile engagement member 106' into the openings 174' of the intermediate portion 422 of the tile engagement member in manner similar to the manner in which the lower portion 146 and the upper portion 144 of the tile engagement member 106 of the scribing tool 100 of the first embodiment are assembled to each other. This locks the upper portion 144' and the intermediate portion 422 of the tile engagement member 106' is position relative to each other.

The lower portion 146' of the tile engagement member 106' is assembled to the intermediate portion 422 of the tile engagement member by inserting the protrusions 428 of the lower portion upwardly into the elongated openings 442 of the intermediate portion. As this occurs, the cam surfaces 438 of the barbs 434 of the protrusions 428 of the lower portion 146' engage against the walls of the elongated openings 442 of the intermediate portion 422 and thereby deflect the first pair of protrusions 424 toward the second pair of the protrusions 426. Eventually, the barbs 434 of the protrusions 428 of the lower portion 146' clear the upper surface 446 of the recess 440 of the intermediate portion 422 and the protrusions thereby resiliently deflect back to their original non-deflected configuration. Once this occurs, the locking surfaces 436 of the barbs 434 of the protrusions 428 of the lower portion 146' are positioned directly above the upper surface 446 of the recess 440 of the intermediate portion 422, and thereby prevent the lower portion from being separated from the intermediate portion. This step of assembling the lower portion 146' of the tile engagement member 106' to the intermediate portion 422 can occur before or after the intermediate portion has been attached to the upper portion 144 of the tile engagement member.

The torsion spring 466 of the scribing tool 100' is assembled to the locking member 108' by inserting the leg portions 492 of the torsion spring downward through the openings 450 of the locking member until the lower surface 490 of the torsion spring engages the top surface 198' of the locking member 108'. To do this, the leg portions 492 of the torsion spring 466 preferably must be resiliently deflected toward each other prior to being inserted into the openings 450 of the locking member 108'. As such, the leg portions 492 of the torsion spring 466 move into the channels 454 of the leg portions 204 of the locking member 108'. This assembly can be done prior or after to assembling the locking member 108' to any of the other components of the scribing tool 100' and it should be appreciated that the resiliency of the torsion spring 466 acts to bias the leg portions 492 of the torsion spring apart from each other after the torsion spring has been assembled to the locking member. It should also be appreciated that the leg portions 492 of the torsion spring 466 are configured and adapted to closely follow the lower portion of the contour of the channels 454 of the locking member 108'.

Figure 35:
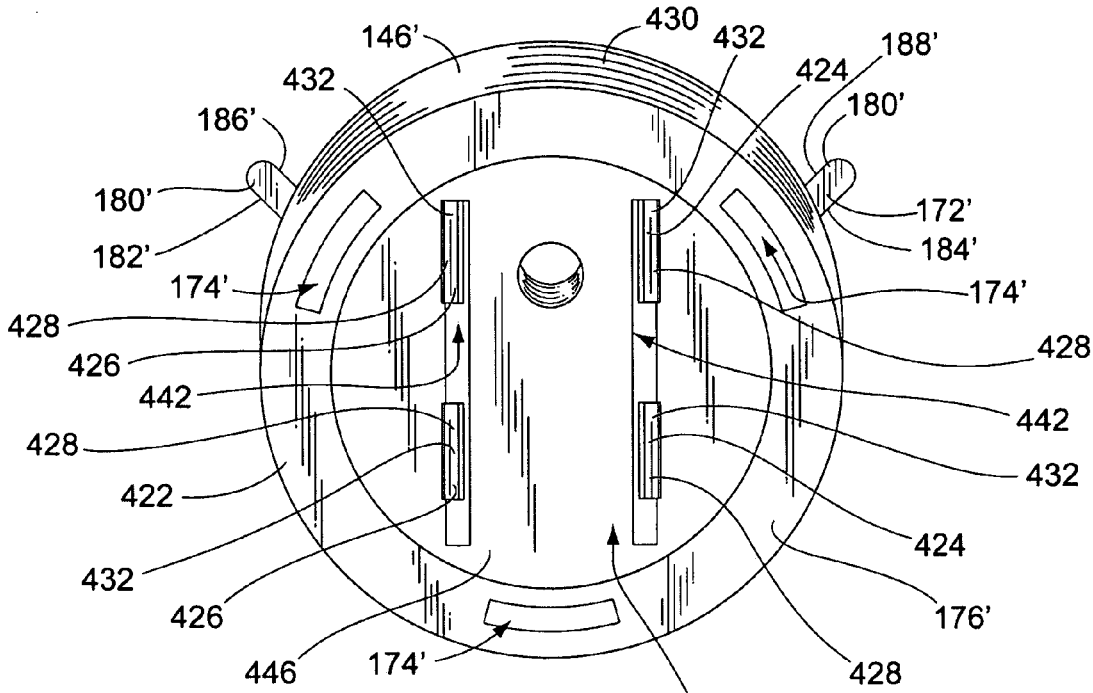
FIG. 35 is a top view of the lower and intermediate portions of the tile engagement member of the scribing tool shown in FIG. 27, assembled together, and is shown with the lower and intermediate portions of the tile engagement member in their measuring configuration.
Figure 36:
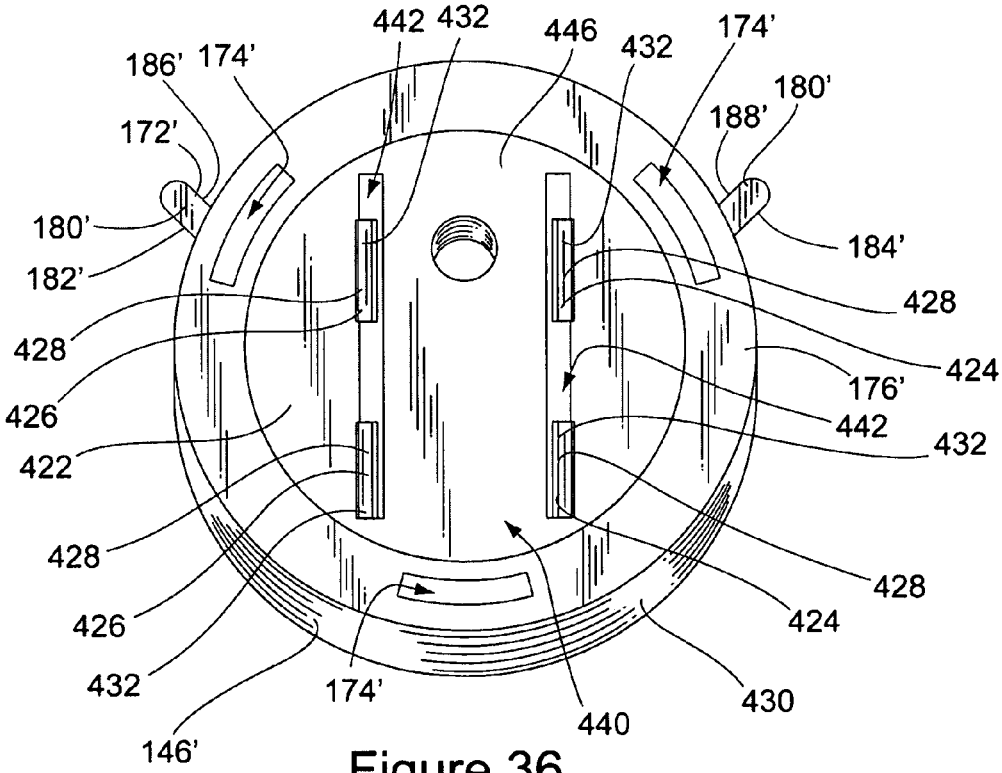
FIG. 36 is a top view of the lower and intermediate portions of the tile engagement member of the scribing tool shown in FIG. 27, assembled together, and is shown with the lower and intermediate portions of the tile engagement member in their scribing configuration.

With the above-mentioned steps of assembly completed, the scribing tool 100' is fully assembled. The scribing tool 100' then functions in a manner similar to the scribing tool 100 of the first embodiment, except for a few notable differences. One difference is that lower portion 146' of the tile engagement member 106' is slideably connected to the upper portion 144' of the tile engagement member. In particular, and as illustrated in FIGS. 35 and 36, the elongate openings 442 of the intermediate portion 422 of the tile engagement member 106' are dimensioned to allow the guide rails 432 of the lower portion 146' to slide horizontally along a linear path relative to the intermediate portion. The linear path is preferably parallel to the plane of symmetry of the L-shaped protrusion 172' of the lower portion 146'. In other words, the linear path is preferably oriented forty-five degrees from each of the legs 180' of the L-shaped protrusion 172' of the lower portion 146'. The elongate openings 442 of the intermediate portion 422 and the guide rails 432 of the lower portion 146' are configured and adapted such that the lower portion can slide only a specific distance relative to the intermediate portion along the linear path and between the two limits shown in FIGS. 35 and 36. Preferably, the specific distance is equal to the square root of the product of two times the square of the thickness of the legs 180' of the of the L-shaped protrusion 172' of the lower portion 146'. As such, the positions of the first engagement portion 182' and the second engagement portion 184' of the L-shaped protrusion 172' of the lower portion 146' relative to the intermediate portion 422 shown in FIG. 35 are generally the same as the positions of the third engagement portion 186' and the fourth engagement portion 188' of the L-shaped protrusion, respectively, relative to the intermediate portion as shown in FIG. 36. Additionally, the guide rails 432 of the lower portion 146' and the elongate openings 442 of the intermediate portion 422 are preferably configured and dimensioned to engage each other in a manner preventing the lower portion from being capable of appreciably pivoting relative to the intermediate portion. However, the lower portion 146' is preferably free to slide relative to the intermediate portion 422 without any appreciable friction therebetween. It should also be appreciated that, because the intermediate portion 422 is rigidly fixed to the upper portion 144' of the tile engagement member 106', the intermediate portion and the lower portion 146' of the tile engagement member pivot and slide with the upper portion relative to the extension member 104'.

Another functional difference between the scribing tool 100' of the second embodiment and the scribing tool 100 of the first embodiment pertains to the pivotal movement between the scribe member 102' and the extension member 104'. Notably, the pivotal action between the scribe member 102' and the extension member 104' is controllable in a manner selectively allowing such pivotal action or, alternatively, preventing such pivotal action. In particular, the configuration of the attachment portion 112' of the scribe member 102' and the attachment portion 136' of the extension member 104', in combination with the release member 462 and the compression spring 464, allows the scribe member to freely pivot relative to the extension member when the scribe member and the extension member are in their unlocked condition shown in FIG. 41 and prevents such pivotal motion when the scribe member and the extension member are in their locked condition shown in FIG. 42. To alter the scribe member and the extension member from their locked configuration shown in FIG. 42 to their unlocked condition shown in FIG. 41, a force must preferably be applied to the top surface 472 of the release member 462 that is sufficient to further compress the compression spring 464 in a manner allowing the release member to move downward relative to the scribe member 102'. When the force is released, the stored energy in the compression spring 464 acts to automatically force the release member 462 upward relative to the scribe member 102' and back into the locked condition shown in FIG. 42.

Figure 41:
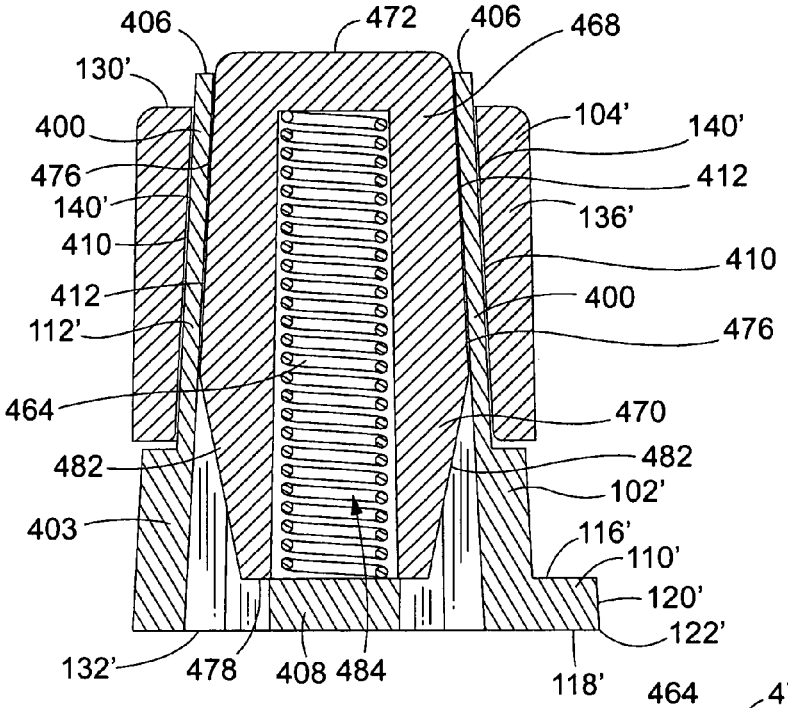
FIG. 41 is a cross-sectional view of the assembly shown in FIG. 29, taken about the line 41-41 shown in FIG. 29, and is shown with the release member in the unlocked condition.

In the unlocked condition shown in FIG. 41, the release member is disengaged with the locking protrusions 400 of the scribe member 102'. As such, the locking protrusions 400 of the scribe member 102' are in an undeflected condition where they are also disengaged with the frustoconical surface 140' of the attachment portion 136' of the extension member 104'. Thus, in this configuration, the attachment portion 136' of the extension member 104' is free to pivot about a vertical axis around the attachment portion 112' of the scribing tool 102'. Moreover, the extension member 104' is thereby able to pivot relative to the scribe member 102' with no appreciable friction. This eliminates any possibility that the extension member 104' will deflect as it is pivoted relative to the scribe member 102'. However, it should be appreciate that, as mentioned above, preferably an applied force must be exerted on the release member 462 to maintain the scribe member 102' in the unlocked position.

When the applied force is released, the stored energy in the compression spring 464 forces the release member 462 upwards relative to the scribe member 102'. This causes the front and back surfaces 476 of the upper portion 468 of the release member 462 to engage the locking protrusions 400 of the scribe member 102' in a manner causing the locking protrusions to resiliently deflect away from each other and against the frustoconical surface 140' of the extension member 104'. Thus, the locking protrusions 400 of the scribe member 102' become sandwiched between the release member 462 and the frustoconical surface 140' of the extension member 104' as shown in FIG. 42 and prevent the release member from moving further upward relative to the scribe member. Additionally, in this locking configuration, the locking protrusions 400 of the scribe member 102' exert a sufficient amount of contact pressure on the frustoconical surface 140' of the extension member 104' to thereby frictionally prevent the extension member from pivoting relative to the scribe member. It should be appreciated that, as a result of the sloped configuration of the front and back surfaces 476 of the upper portion 468 of the release member 462, the total contact force acting on the frustoconical surface 140' of the extension member 104' is many times greater than the force of exerted on the release member by the compression spring 464. Thus, the frictional force is rather large. It should also be appreciated that, because the front and back surfaces 476 of the upper portion 468 of the release member 462 and the inner surfaces 412 of the locking protrusions 400 of the scribe member 102' are each partial cylindrical surfaces, these surfaces remain congruent when engaged with each other regardless of the vertical position of the release member relative to the scribe member. Still further, it should be appreciated that the shape of these surfaces limit the release member 462 from pivoting within the attachment portion 112' of the scribe member 102'.

The steps of scribing tile using the scribing tool 100' of the second embodiment are generally the same as the steps of scribing tile using the scribing tool 100 of the first embodiment. However, some differences do exist. For example, during the step of sliding the locking member 108' and the tile engagement member 106' toward the projected intersection of the straight edges 308,310 of the first 300 and second tiles 302, the release member 462 is preferably forced downward against the scribe member 102' such that the scribe member is in the unlocked position relative to the extension member 104'. Thus, unlike the scribing tool 100 of the first embodiment, the scribe member 102' of the second embodiment is able to freely pivot relative to the extension member 104' during this step such that no threshold moment is required to pivot the scribe member relative to the extension member. The downward force on the release member 462 can easily be applied by the same hand that is holding the straight edge 122' of the scribe member 102' of the scribing tool 100' in alignment with the boundary perimeter 312 that partially defines the space 306 onto which a tile is sought to be placed.

Yet another difference between the use of the scribing tool 100' of the second embodiment and that of the scribing tool 100 of the first embodiment is that the sliding nature of the attachment of the lower portion 146' relative to the intermediate portion 422 of the tile engagement member 106' adapts and configures the tile engagement member for use in situations where the tiles being laid abut each other and lack any grout therebetween. In particular, during the above-mentioned step of using of the scribing tool 100', the lower portion 146' of the tile engagement member 106' automatically slides into the position shown in FIG. 35 relative to the intermediate portion 422 as the L-shaped protrusion 172 of the lower portion 146 of the tile engagement member is forced into engagement with the straight edges 308,310 of the first 300 and second tiles 302. Once this occurs, the release member 462 and the locking member 108' of the scribing tool 100' are released. This causes the locking member 108' to move into its locking position and thereby locks the upper portion 144' and the intermediate portion 422 of the tile engagement member 106' in position relative to the extension member 104'. Additionally, this locks the scribe member 102' in position relative to the extension member 104'. However, the lower portion 146' of the tile engagement member 106' remains free to slide relative to the upper portion 144' and the intermediate portion 422 of the tile engagement member. As such, during the next step of positioning the scribing tool 100' relative to the yet to be placed or cut third tile 316, the lower portion 146' of the tile engagement member 106' slides into the position shown in FIG. 36 relative to the intermediate portion 422. This occurs naturally and without effort as the third 186' and fourth 188' engagement portions of the legs 180' of the tile engagement member 106' are engaged and aligned with the first 320 and second 322 edges of the third tile 316. It should be appreciated that the movement of the lower portion 146' relative to the intermediate portion 422 of the tile engagement member 106' compensates for the thickness of the legs 180' of the L-shaped protrusion 172' of the lower portion. In other words, the sliding nature of the lower portion 146' of the tile engagement member 106' positions the scribe member 102' relative to the third tile 316 such that, after the third tile has been scribed and then cut, the perimeter of the third tile will be substantially identical to the perimeter of the space 306 onto which the third tile is sought to be placed, when the third tile abuts both the first 300 and second 302 tiles.

The other steps of using the scribing tool 100' of the second embodiment are preferably identical to the steps of using the scribing tool 100 of the first embodiment. Thus, the utility of the scribing tool 100' of the second embodiment should be appreciated. Additionally, it should be appreciated that the lower portion 146' and intermediate portion 422 of the tile engagement member 106' of the scribing tool 100' of the second embodiment, in combination with each other, are interchangeable with the lower portion 146 of the tile engagement member 106 of the scribing tool 100 of the first embodiment. Thus, both the scribing tool 100' of the second embodiment and the scribing tool 100 of the first embodiment can be adapted for use scribing tile when such tile is being laid with or without grout between the tiles.

In view of the foregoing, it should be appreciated that the scribing tools and their methods of use allow people to rapidly scribe tile without measuring and without performing cumbersome other steps associated with previous scribing tools and techniques. Moreover, a scribing tool in accordance with the invention can be configured to automatically take into account the grout width between tiles being laid or to be useful when tile is being laid without any such grout width between such tiles. To this end, it is preferable to sell the scribing tool as a kit that comprises multiple lower portions of the tile engagement member that are each configured to accommodate specific standard grout widths and that comprises the lower portion and intermediate portion of the tile engagement member of the second embodiment described above. Still further, it should be appreciated that scribing tools in accordance with the invention can be produced economically and, if desired, entirely out of plastic via two-part molds. Additionally, the pivoting action between the extension member and both the tile engagement member and the scribe member makes the scribing tools extremely versatile. Thus, the scribing tools and method of the invention overcome the disadvantages associated with previous methods and apparatus used to scribe tile and appreciably increase the efficiency of the vast majority of tiling projects.

While the present invention has been described in reference to specific embodiments, in light of the foregoing, it should be understood that all matter contained in the above description or shown in the accompanying drawing figures is intended to be interpreted as illustrative and not in a limiting sense and that various modifications and variations of the invention may be constructed without departing from the scope of the invention defined by the following claims. Thus, it should be appreciated that the tile engagement portions of the tile engagement member need not be portions of an L-Shaped protrusion, but instead could formed by multiple protrusions of practically any shape. For example, the third and fourth tile engagement portions could comprise protrusions that create two point-contacts for engaging against the first edge of the third tile and one point-contact for engaging against the second edge of the third tile. As such, basically any configuration that would allow the tile engagement member to be aligned with both the first and second edge of the third tile could suffice. Moreover, the locking member need not be configured as described and could be configured to operate in an entirely different manner than described. Yet further, it should be appreciated that the scribe member could comprise multiple elements that are movable relative to each other or could even be flexibly adjustable, and that the scribe edge of the scribe member need not be a straight edge. Likewise, the locking member or the extension member could comprise multiple components. Thus, other possible variations and modifications of the claimed invention should be appreciated, but not limited.

Furthermore, it should be understood that when introducing elements of the present invention in the claims or in the above description of the preferred embodiments of the invention, the terms "comprising," "including," and "having" are intended to be open-ended and mean that there may be additional elements other than the listed elements. Similarly, the term "portion" should be construed as meaning some or all of the item or element that it qualifies.

What is claimed is:

1. An apparatus for scribing tile comprising:

a scribe member;

a tile engagement member;

an extension member, the extension member connecting the scribe member to the tile engagement member, the extension member being both slideably and pivotally connected to the tile engagement member; and a locking member, the locking member being movable between a locking position and an unlocking position, the locking member preventing movement of the tile engagement member relative to the extension member when the locking member is in the locking position and allowing both pivotal and slideable movement of the tile engagement member relative to the extension member when the locking member is in the unlocking position, the locking member being biased from the unlocking position toward the locking position, the locking member comprising a cam surface and the tile engagement member comprising a cam surface, the cam surface of the locking member engaging the cam surface of the tile engagement member when the locking member is in the locking position in a manner such that the extension member is in clamped engagement with the tile engagement member.

2. An apparatus in accordance with claim 1 wherein the scribe member is pivotally connected to the extension member.

3. An apparatus in accordance with claim 1 wherein the locking member is fixed in rotation to the extension member in a manner such that the locking member rotationally moves together with the extension member relative to the tile engagement member.

4. An apparatus for scribing tile comprising:

a scribe member;

a tile engagement member;

an extension member, the extension member connecting the scribe member to the tile engagement member, the extension member being slideably connected to the tile engagement member and pivotally movable relative to the tile engagement member about a pivot axis; and a locking member, the locking member being movable between a locking position and an unlocking position, the locking member preventing movement of the tile engagement member relative to the extension member when the locking member is in the locking position and allowing both pivotal and slideable movement of the tile engagement member relative to the extension member when the locking member is in the unlocking position, the locking member being biased from the unlocking position toward the locking position, the locking member comprising an actuation portion, the actuation portion being movable toward the pivot axis in a manner to move the locking member from the locking position to the unlocking position and being movable away from the pivot axis in a manner to move the locking member from the unlocking position to the locking position.

5. An apparatus in accordance with claim 4 wherein the scribe member is pivotally connected to the extension member.

6. An apparatus in accordance with claim 4 wherein the locking member is fixed in rotation to the extension member in a manner such that the locking member rotationally moves together with the extension member relative to the tile engagement member.

7. An apparatus for scribing tile comprising:

a scribe member;

a tile engagement member;

an extension member, the extension member connecting the scribe member to the tile engagement member, the extension member being movably connected to the tile engagement member; and a locking member, the locking member being movable between a locking position and an unlocking position, the locking member preventing movement of the tile engagement member relative to the extension member when the locking member is in the locking position and allowing movement of the tile engagement member relative to the extension member when the locking member is in the unlocking position, the locking member being biased from the unlocking position toward the locking position;

first and second actuation portions, the first and second actuation portions each being movable relative to the tile engagement member, the first and second actuation portions also being movable toward each other in a manner to move the locking member from the locking position to the unlocking position and being movable away from each other in a manner to move the locking member from the unlocking position to the locking position.

8. An apparatus in accordance with claim 7 wherein the extension member is both pivotally and slideably movable relative to the tile engagement member when the locking member is in the unlocking position.

9. An apparatus in accordance with claim 7 wherein the scribe member is pivotally connected to the extension member.

10. A scribing tool comprising a scribe member, an extension member, and a tile engagement member, the tile engagement member being connected to the scribe member via the extension member, the scribe member being pivotally connected to the extension member about a first axis, the tile engagement member comprising first and second portions, the first portion of the tile engagement member being slideably connected to the extension member, the second portion of the tile engagement member being pivotally connected to the extension member via the first portion of the tile engagement member about a second axis that is movable with the first portion relative to the extension member, the second portion of the tile engagement member being movable relative to the first portion of the tile engagement member along a path that extends through a first plane that is parallel to and includes the second axis, the path and the first plane being pivotally movable with each other and with the second portion of the tile engagement member about the second axis relative to the extension member and being slideably movable with the first portion of the tile engagement member relative to the extension member.

11. A scribing tool in accordance with claim 10 wherein the scribing tool is adapted and configured such that the tile engagement member and the extension member have a locked condition and an unlocked condition relative to each other, the first portion of the tile engagement member and the second axis are slideably movable relative to the extension member when the tile engagement member and the extension member are in their unlocked condition and are translationally fixed relative to the extension member when the tile engagement member and the extension member are in their locked condition, and the second portion of the tile engagement member is pivotally movable about the second axis relative to the extension member when the tile engagement member and the extension member are in their unlocked condition and is rotationally fixed relative to the extension member when the tile engagement member and the extension member are in their locked condition.

12. A scribing tool in accordance with claim 11 wherein the second portion of the tile engagement member is movable along the path relative to the first portion of the tile engagement member when the tile engagement member and the extension member are in their locked condition.

13. A scribing tool in accordance with claim 11 wherein the scribing tool is adapted and configured such that an applied force is required to place the tile engagement member and the extension member in their unlocked condition and such that the tile engagement member and the extension member are automatically placed in their locked condition when the applied force is released.

14. A scribing tool in accordance with claim 10 wherein the path is a linear path.

15. A scribing tool in accordance with claim 14 wherein the second portion of the tile engagement member comprises first, second, third, and fourth engagement portions, the first and second engagement portions define a first right-angle that is rotationally and translationally fixed in orientation with respect to the second portion of the tile engagement member, the third and fourth engagement portions define a second right-angle that is rotationally and translationally fixed in orientation with respect to the second portion of the tile engagement member, the first right-angle is parallel to the second right-angle and is spaced from the second right-angle by a first distance, the linear path is parallel to a second plane that bisects each of the first and second right-angles, and the movement of the second portion of the tile engagement member relative to the first portion of the tile engagement member along the liner path is limited to a second distance that is equal to the square root of the product of two times the square of the first distance.

16. A scribing tool in accordance with claim 15 wherein the second axis lies in the second plane.

17. A scribing tool in accordance with claim 10 wherein the scribing tool is adapted and configured such that the scribe member and the extension member have a locked condition and an unlocked condition relative to each other, and the scribe member is pivotally movable relative to the extension member about the first axis when the scribe member and the extension member are in their unlocked condition and is rotationally fixed relative to the extension member when the scribe member and the extension member are in their locked condition.

18. A scribing tool in accordance with claim 17 wherein the scribing tool is adapted and configured such that an applied force is required to place the scribe member and the extension member in their unlocked condition and such that the scribe member and the extension member are automatically placed in their locked condition when the applied force is released.

19. A scribing tool in accordance with claim 10 wherein the first axis is parallel to the second axis, the first portion of the tile engagement member is slideably movable relative to the extension member in direction that is perpendicular to each of the first and second axes, and the path lies in a second plane that is perpendicular to the second axis.

20. A scribing tool comprising a scribe member, an extension member, and a tile engagement member, the tile engagement member being connected to the scribe member via the extension member, the tile engagement member being slideably connected to the extension member, the scribing tool being adapted and configured such that the scribe member and the extension member have a locked condition and an unlocked condition relative to each other, the scribe member being pivotally movable relative to the extension member about a first axis when the scribe member and the extension member are in their unlocked condition and being rotationally fixed relative to the extension member when the scribe member and the extension member are in their locked condition, the scribing tool being further adapted and configured such that an applied force is required to place the scribe member and the extension member in their unlocked condition and such that the scribe member and the extension member are automatically placed in their locked condition when the applied force is released.

21. A scribing tool in accordance with claim 20 wherein the tile engagement member is pivotally connected to the extension member about a second axis, and the second axis is slideably movable with the tile engagement member relative to the extension member.

22. A scribing tool in accordance with claim 21 wherein the scribing tool is adapted and configured such that the tile engagement member and the extension member have a locked condition and an unlocked condition relative to each other, the second axis is slideably movable relative to the extension member with the tile engagement member when the tile engagement member and the extension member are in their unlocked condition and is translationally fixed relative to the extension member when the tile engagement member and the extension member are in their locked condition, and the tile engagement member is pivotally movable about the second axis relative to the extension member when the tile engagement member and the extension member are in their unlocked condition and is rotationally fixed relative to the extension member when the tile engagement member and the extension member are in their locked condition.

23. A scribing tool in accordance with claim 20 wherein the tile engagement portion comprises first and second portions, the second portion of the tile engagement member is movable relative to the first portion along a path, and the second portion of the tile engagement member and the path are movable with the first portion of the tile engagement member relative to the extension member.

24. A scribing tool in accordance with claim 23 wherein the second portion of the tile engagement member is pivotally connected to the extension member of the tile engagement member via the first portion of the tile engagement member about a second axis that is movable with the first portion relative to the extension member, the path extends through a first plane that is parallel to and includes the second axis, and the path and the first plane are pivotally movable with each other and with the second portion of the tile engagement member about the second axis relative to the extension member and are slideably movable with the first portion of the tile engagement member relative to the extension member.

25. A scribing tool in accordance with claim 24 wherein the scribing tool is adapted and configured such that the tile engagement member and the extension member have a locked condition and an unlocked condition relative to each other, the first portion of the tile engagement member and the second axis are slideably movable relative to the extension member when the tile engagement member and the extension member are in their unlocked condition and are translationally fixed relative to the extension member when the tile engagement member and the extension member are in their locked condition, the second portion of the tile engagement member is pivotally movable about the second axis relative to the extension member when the tile engagement member and the extension member are in their unlocked condition and is rotationally fixed relative to the extension member when the tile engagement member and the extension member are in their locked condition, and the second portion of the tile engagement member is movable along the path relative to the first portion of the tile engagement member when the tile engagement member and the extension member are in their locked condition.

* * * * *